US008688012B2

(12) United States Patent
Matsumoto et al.

(10) Patent No.: US 8,688,012 B2
(45) Date of Patent: Apr. 1, 2014

(54) DEVELOPING DEVICE AND IMAGE FORMING APPARATUS

(75) Inventors: Junichi Matsumoto, Kanagawa (JP); Tomoya Ohmura, Kanagawa (JP); Yasuo Takuma, Kanagawa (JP); Hiroshi Kikuchi, Kanagawa (JP); Natsumi Matsue, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 209 days.

(21) Appl. No.: 13/287,578

(22) Filed: Nov. 2, 2011

(65) Prior Publication Data

US 2012/0114349 A1 May 10, 2012

(30) Foreign Application Priority Data

Nov. 4, 2010 (JP) ..... 2010-247846
Nov. 4, 2010 (JP) ..... 2010-247850

(51) Int. Cl.
*G03G 15/08* (2006.01)

(52) U.S. Cl.
USPC ..... 399/254; 399/27; 399/258

(58) Field of Classification Search
USPC ..... 399/254, 256, 258, 27, 53
See application file for complete search history.

(56) References Cited

U.S. PATENT DOCUMENTS

| | | | | |
|---|---|---|---|---|
| 7,636,536 | B2 | 12/2009 | Iwata et al. | |
| 7,729,642 | B2 | 6/2010 | Matsumoto et al. | |
| 7,783,233 | B2 | 8/2010 | Iwata et al. | |
| 7,792,472 | B2 | 9/2010 | Ichikawa et al. | |
| 7,835,653 | B2 | 11/2010 | Katoh et al. | |
| 7,912,408 | B2 | 3/2011 | Iwata et al. | |
| 7,953,350 | B2 | 5/2011 | Matsumoto et al. | |
| 8,090,276 | B2 * | 1/2012 | Kasai | 399/27 |
| 8,213,836 | B2 * | 7/2012 | Kato et al. | 399/254 |
| 2007/0053721 | A1 | 3/2007 | Matsumoto et al. | |
| 2007/0053723 | A1 | 3/2007 | Iwata et al. | |
| 2007/0154242 | A1 | 7/2007 | Matsumoto et al. | |

(Continued)

FOREIGN PATENT DOCUMENTS

| | | | |
|---|---|---|---|
| JP | 8036294 | A | 2/1996 |
| JP | 3734096 | B2 | 5/1996 |

(Continued)

OTHER PUBLICATIONS

Abstract of JP 08-123198 published May 17, 1996.

(Continued)

*Primary Examiner* — Sophia S Chen
(74) *Attorney, Agent, or Firm* — Harness, Dickey & Pierce, P.L.C.

(57) ABSTRACT

In a disclosed developing device, a developing part includes a developer carrier for circulating a developer inside the developing part and for supplying the developer to an image carrier, a developer supply member for supplying the developer to the developer carrier, and a developer collection member for collecting the developer which is not used. A developer stirring part is arranged at a different position from a position of the developing part. A developer conveyance part carries the developer by an air conveyance in a developer conveyance path from the developer stirring part to the developing part. A developer detection part includes an opening which communicates between the developer supply member and the developer collection member, is arranged at a downstream side in a flow direction of the developer below and near the developer supply member, and detects whether the developer exists in a vicinity of the developer supply member.

19 Claims, 19 Drawing Sheets

(56) References Cited

U.S. PATENT DOCUMENTS

| | | | | |
|---|---|---|---|---|
| 2007/0166079 | A1 | 7/2007 | Ichikawa et al. | |
| 2007/0264053 | A1 | 11/2007 | Iwata et al. | |
| 2007/0274740 | A1 | 11/2007 | Katoh et al. | |
| 2008/0226349 | A1 | 9/2008 | Iwata et al. | |
| 2008/0298844 | A1 | 12/2008 | Katoh et al. | |
| 2008/0298845 | A1 | 12/2008 | Ohmura et al. | |
| 2008/0298866 | A1 | 12/2008 | Matsumoto et al. | |
| 2009/0028611 | A1 | 1/2009 | Matsumoto et al. | |
| 2009/0041508 | A1 * | 2/2009 | Oshikawa et al. | 399/254 |
| 2009/0123174 | A1 | 5/2009 | Iwata et al. | |
| 2009/0317106 | A1 | 12/2009 | Ohmura et al. | |
| 2010/0061774 | A1 | 3/2010 | Iwata et al. | |
| 2010/0124443 | A1 | 5/2010 | Ohmura et al. | |
| 2010/0143000 | A1 | 6/2010 | Matsue et al. | |
| 2010/0290815 | A1 | 11/2010 | Ichikawa et al. | |
| 2011/0044726 | A1 | 2/2011 | Katoh et al. | |
| 2011/0182610 | A1 | 7/2011 | Ohmura et al. | |
| 2011/0229207 | A1 | 9/2011 | Matsumoto et al. | |

FOREIGN PATENT DOCUMENTS

| | | | |
|---|---|---|---|
| JP | 3349286 | B2 | 8/1996 |
| JP | 2009047989 | A | 3/2009 |
| JP | 2009198967 | A | 9/2009 |

OTHER PUBLICATIONS

Abstract of JP 08-211723 published Aug. 20, 1996.
Abstract of JP 08-036294 published Feb. 6, 1996.
Abstract of JP 2009-198967 published Sep. 3, 2009.
Abstract of JP 2009-047989 published Mar. 5, 2009.

* cited by examiner

DEVELOPING DEVICE AND IMAGE FORMING APPARATUS

BACKGROUND OF THE INVENTION

1. Field of the Invention

The present invention generally relates to an image forming apparatus such as a copier, a facsimile machine, a printer, or the like applying an electrophotographic method to form an image by using toner, and more particularly to operations control of a developing device.

2. Description of the Related Art

A developing device included in an image forming apparatus applying an electrophotographic method develops and visualizes an electrostatic latent image formed on an image carrier by using a developer including two components: toner and a carrier. In the developing device, in which a developing process ends in a developing area and the toner is consumed, the developer is collected and is used again for developing an image after being mixed and stirred with replenished toner. The developer used for the developing device is needed to maintain a constant toner density and charge quantity in order to acquire a stable toner image. The toner image is adjusted with the consumed toner for image formation and the replenished toner. The charge quantity is given by a frictional charge when the toner is mixed with the carrier. In the developing device using the developer including the two components, the toner is sufficiently mixed with the carrier to achieve a uniform toner density distribution, and also the toner image is stabilized by charging the toner.

In a general-purpose developing device, the toner is distributed and charged by using a stirring effect of a rotation of two screws within a short time until the replenished toner is pumped up to a developing roller. Especially, in a case of consuming a large amount of toner, the replenished toner is pumped up to the developing roller before being sufficiently distributed. Accordingly, image quality is degraded due to toner scattering or the like.

To solve this problem, a developing device, in which stirring performance is improved by separating a developing part from a developer stirring part, is known. Advantageously, in this developing device, compared with a developing device which conducts stirring and conveying by using a screw, an amount of toner which is not charged or not sufficiently charged becomes smaller, and toner scattering and background fouling occur less. However, since the developing part and the developer stirring part are separately arranged, a developer circulation part for circulating the developer is needed between the developing part and the developer stirring part. As the developer circulation part, Japanese Patents No. 3734096 and No. 3349286 disclose conveying mechanism using an air pump or a mohno pump.

In a case of successively carrying the developer in the tube by using the air, a conveyance amount may fluctuate depending a state of the developer. For example, powder characteristics of the developer are changed depending on a deterioration level, temperature, moisture, and the like of the developer. When a developer capacity of the developing part is decreased due to a decrease of the conveyance amount of the developer, the developer amount to be pumped up to the developing roller becomes insufficient and an image defect occurs. Especially, in a case in which a one-way circulation system is applied to the developing device, the developer is supplied to the developing roller from a supply screw arranged parallel to the developing roller, and the developer being supplied is carried to a collection screw after an imaging operation. The developer amount in a vicinity of the supply screw becomes less toward a downstream side of a flow direction of the developer (a volume decreases more). Accordingly, when the conveyance amount of the developer decreases, a depletion state occurs, in which the developer is not supplied to the developing roller at the downstream side in the flow direction of the developer. To prevent the occurrence of the depletion state beforehand, it may be considered to control the conveyance amount of the developer by detecting the developer amount in the vicinity of the supply screw.

Accordingly, a powder surface and the volume of the developer in the imaging device may be detected, and the conveyance amount of the developer may be controlled based on a detection result. Japanese Laid-open Patent Applications No. H08-36294 and No. 2009-198967 disclose a developing device using a piezoelectric oscillation element or a magnetic permeability detection method.

In the above-described technologies, the piezoelectric oscillation element is used to detect whether the powder surface of the developer is higher than a predetermined height. However, the supply screw and the collection screw are provided. Thus, in the developing device in which the developer supplied from the supply screw to the developing roller is not supplied again to the developing roller, the powder surface of the developer at a downstream side of the supply screw is significantly lower than that at an upstream side of the supply screw. The powder surface fluctuates along a slope of a screw, and thus, is not constant. Thus, these problems make an output of the powder surface unstable and a detection of the powder surface becomes difficult. Also, in a case in which a magnetic permeability sensor is used as a powder surface detection part, since both the powder surface and the toner density change, the powder surface is not detected if the toner density is not accurately recognized.

As described above, the developing device included in the image forming apparatus of the electrophotographic method is known in which the developing part and the developer stirring part are separately arranged and a stirring performance is improved. Since the developing part and the developer stirring part are separately arranged, developer circulation part for circulating the developer is needed between the developing part and the developer stirring part. As the developer circulation part, the conveying mechanisms using the air pump or the mohno pump are known.

A developer conveyance by air is influenced by bulk density, fluidity, toner density, and the like of the developer and the conveyance amount fluctuates. A developer balance between the developing part and the developer stirring part is changed. Especially, when the conveyance amount decreases and a developer capacity of the developing part decreases, a volume of the developer for the screw to be supplied to the developing roller is decreased, and the developer is not sufficiently supplied to the developing roller. An amount of the developer being pumped up is decreased at a downstream side of the developing roller after the developer passes a doctor blade. As a result, an image density irregularity may occur. Also, due to the decrease of the developer capacity of the developing part, an amount of the developer of the developer stirring part increases. Thus, a torque driving a stirring member is increased and a load becomes greater. Accordingly, it is needed to control a circulation amount of the developer to be constant, to stabilize the pumped-up amount and the developer balance between the developing part and the developer stirring part.

In order to maintain a height of a powder surface of the developer at the downstream side of the supply screw, regardless of an image to be formed, Japanese Laid-open Patent Application No. 2009-47989 discloses a developing device which controls a developer supply amount for the developing part based on a number of pixels to be written, a detection result of the toner density by a toner density detection part, a toner amount to be replenished in the externally arranged developing stirring part, and a driving time of the developing device. This technology is effective to increase and decrease an average conveyance amount due to the toner density and the fluidity of the developer.

However, as illustrated in FIG. 1, the developer conveyance using the air is performed in which the conveyance amount is carried with fluctuation (pulsation) at a shorter interval. When the powder surface is temporarily lowered due to the pulsation of the conveyance amount, the developer conveyance may not be sufficiently performed for this case. It has been known that a scale of the pulsation depends on conveyance conditions such as the fluidity, a supply amount of the air, and the like of the developer. When the supply amount of the air is increased or a rotation of the rotary re-feeder is increased to increase the conveyance amount, the pulsation becomes greater in response to these increases. Also, since the pulsation of the powder surface becomes greater, the powder surface fluctuates. It becomes difficult to accurately detect and control the powder surface.

To correspond to a change of the conveyance amount of the developer due to the pulsation, it is required to detect the powder surface and the volume of the developer in the developing device, and to control the conveyance amount of the developer using the air based on a detection result. Japanese Laid-open Patent Applications No. H08-36294 and No. 2009-198967 disclose a developing device using a piezoelectric oscillation element or a magnetic permeability detection method.

SUMMARY OF THE INVENTION

The present invention solves or reduces one or more of the above problems.

In one aspect of this disclosure, there is provided a developing device, including a developing part configured to include a developer carrier which is arranged in a vicinity of an image carrier, and which is rotatable for circulating a developer inside the developing part and for supplying the developer to the image carrier; a developer supply member which is rotatable and carries and supplies the developer to the developer carrier; and a developer collection member which collects the developer which is not used to develop an image; a developer stirring part configured to be arranged at a different position from a position of the developing part; a developer conveyance part configured to carry the developer by an air conveyance in a developer conveyance path from the developer stirring part to the developing part, in which the developer circulated in the developing part returns to the developer stirring part through a developer ejection flow path; and a developer detection part configured to include an opening which communicates between the developer supply member and the developer collection member, to be arranged at a downstream side in a flow direction of the developer from the opening below and near the developer supply member, and to detect whether the developer exists in a vicinity of the developer supply member.

In another aspect of this disclosure, there is provided a developing device, including a developing part configured to include a developer carrier which is arranged in a vicinity of an image carrier, and which is rotatable for circulating a developer inside the developing part and for supplying the developer to the image carrier; and a developer supply member which is rotatable and carries and supplies the developer to the developer carrier; a developer stirring part configured to be arranged at a different position from a position of the developing part; a developer conveyance part configured to carry the developer by an air conveyance in a developer conveyance path from the developer stirring part to the developing part, in which the developer circulated in the developing part returns to the developer stirring part through a developer ejection flow path; and a powder surface detection part configured to detect a powder surface of the developer contained in the developing part in a vicinity of and below the developer supply member, wherein a conveyance amount of the developer carried by the developer conveyance to the developing part is controlled so that a fluctuation width of an output value of the powder surface detection part exceeds a predetermined value.

BRIEF DESCRIPTION OF THE DRAWINGS

In the following, embodiments of the present invention will be described with reference to the accompanying drawings.

DESCRIPTION OF THE PREFERRED EMBODIMENT

In the following, an embodiment of the present invention will be described with reference to the accompanying drawings.

Figure 1:
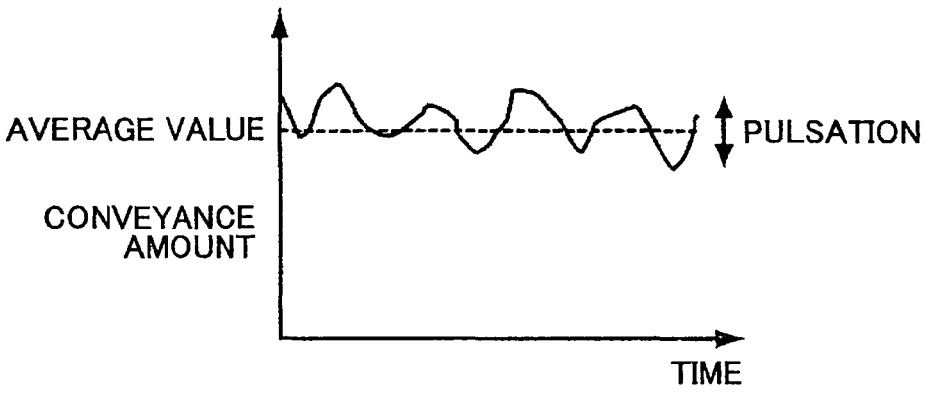
FIG. 1 is a graph for explaining that a conveyance amount of the developer fluctuates when the developer is carried by air.
Figure 2:
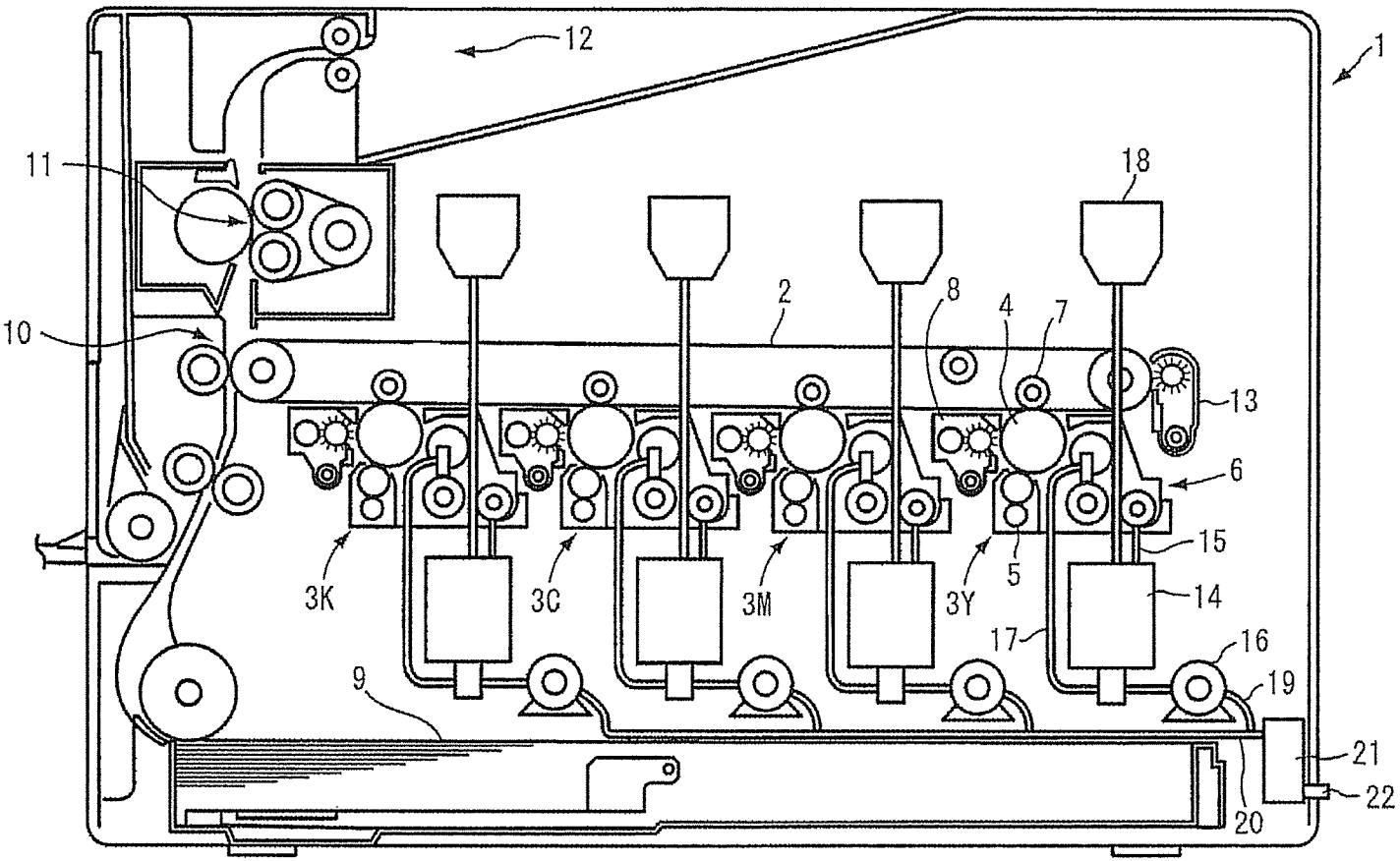
FIG. 2 illustrates a schematic front view of an image forming apparatus in which a developing device according to a first embodiment is applicable.

FIG. 2 is a diagram illustrating an image forming apparatus in which a developing device according to a first embodiment is applicable. In FIG. 2, the image forming apparatus 1 is regarded as a tandem type of an image forming apparatus, and includes imaging units 3Y, 3M, 3C, and 3K corresponding to yellow (Y), magenta (N), cyan (C), and black (K) down below an intermediate transfer belt 2. The imaging units 3Y, 3M, 3C, and 3K have similar configurations including photosensitive drums 4 as image carriers, charging parts 5, developing parts 6 forming developing devices, primary transfer members 7, cleaning devices 8, and the like.

In the image forming apparatus 1, when an imaging operation starts, the photosensitive drums 4 are uniformly charged by the charging parts 5. Next, electrostatic latent images, which correspond to an image to be formed by a writing unit (not shown) are formed on surfaces of the photosensitive drums 4. Then, toner images respective to colors are formed on the photosensitive drums 4 by supplying the toner to the electrostatic latent images from the developing parts 6. Toner images of respective colors formed on the photosensitive drums 4 are superimposedly transferred onto the intermediate transfer belt 2, thereby forming a full color toner image of four colors on the intermediate transfer belt 2. The full color toner image is transferred onto a paper sheet, which is supplied by a feeding roller, a registration roller, and the like from a feeding cassette 9, by a secondary transfer member 10. The paper sheet, onto which the toner image is transferred, is passed through a fixing part 11 to be heated and pressed. After the toner image is fixed by heat and pressure, the paper sheet is ejected by an ejection part 12. After the toner image is transferred, the cleaning devices 8 eliminate residual toner on surfaces of the respective photosensitive drums 4, and a belt cleaning device 13 eliminates residual toner on the surface of the intermediate transfer belt 2.

In the image forming apparatus 1, the developing device has the following features. In a general-purpose developing device, the toner and a carrier of a developer used to develop an image are stirred and mixed in a developing unit. In the developing device in the embodiment, developer stirring parts 14 are arranged separately from the developing parts 6 provided respectively in the imaging units 3Y, 3M, 3C, and 3K. The developer stirring parts 14 certainly stir and mix the developer and replenished toner, and stably conduct toner distribution and charging. By operations of the developer stirring parts 14, toner density and toner charges are stabilized. Accordingly, a preferable image formation is stably performed. After an imaging operation, the developer is carried through developer ejection flow paths 15 from the developing parts 6 to the developer stirring parts 14. In the developing stirring parts 14, new toner is replenished, and the sufficiently stirred developer is ejected by predetermined amounts by rotary feeders (not shown). The ejected developer is carried by air pressure from air pumps 16 regarded as developer conveyance parts, and is returned to the developing parts 6 via developer conveyance paths 17. The new toner is replenished to the developer stirring parts 14 by small amounts from toner hoppers (or toner cartridge) 18. In FIG. 2, air suction openings 19 are provided to respective air pumps 16, an external air suction path 20 is used to suction the external air, an air dryer 21 is used to dry the external air, and an air intake part 22 is used to take in the external air.

Figure 3:
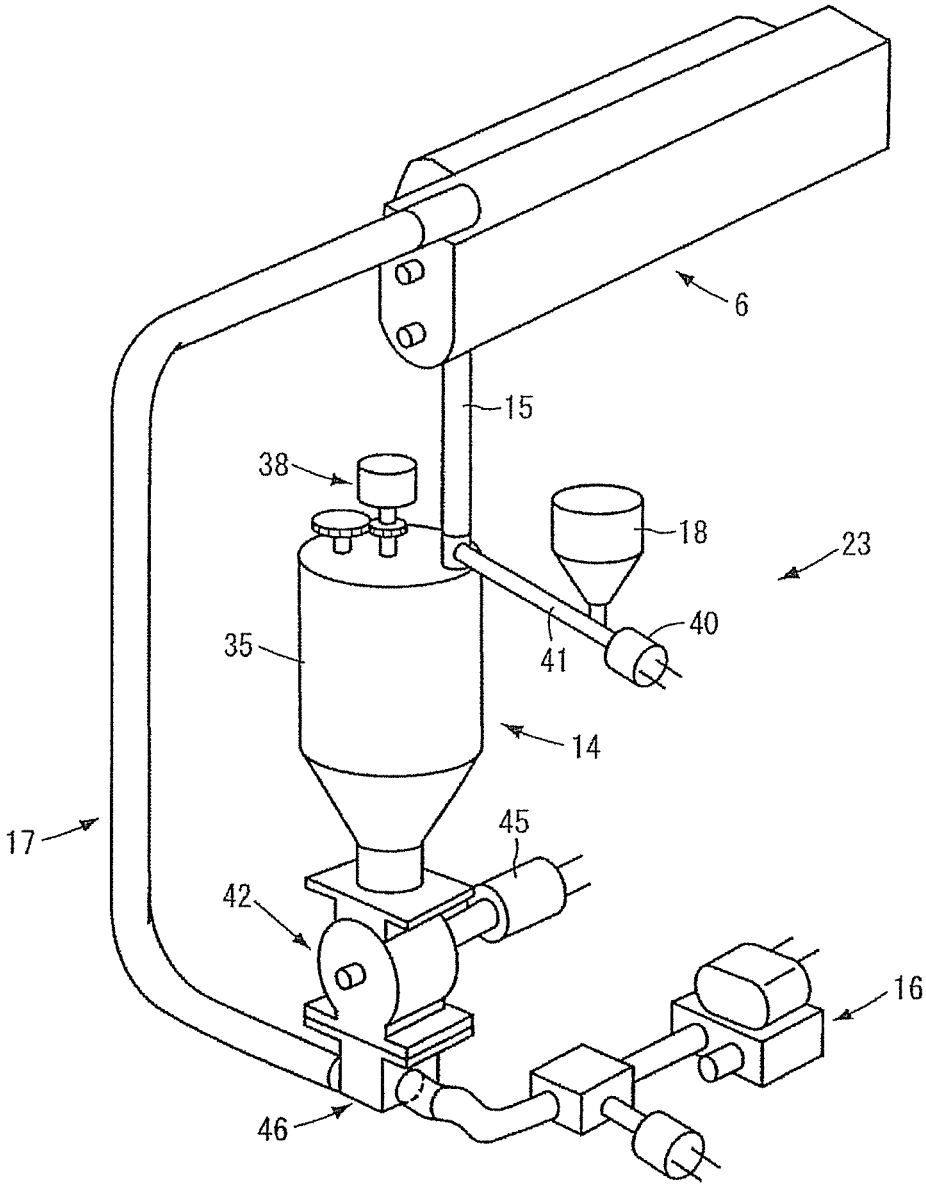
FIG. 3 illustrates a schematic perspective view of the developing device according to the first embodiment.

FIG. 3 is a diagram illustrating a developing device 23 according to the first embodiment. As described above, the developing device 23 includes the developing part 6 oppositely arranged in a vicinity of the photosensitive drum 4, and the developer stirring part 14 arranged separately from the developing part 6. The developer is carried from the developer stirring part 14 to the developer part 6 through the developer conveyance path 17. The developer, in which the toner and the carrier are mixed, is used. Hereinafter, the developer is called a two-component developer.

The developer is carried by air conveyance from the developer stirring part 14 and is supplied to the developing part 6. The developer falls by gravity in the developer ejection flow path 15 connecting the developing part 6 and the developer stirring part 14 and returns to the developing part 6. Thus, the developer is circulated between the developing part 6 and the developer stirring part 14. The developer ejection flow path 15 is formed by a flexible member such as a silicone tube or the like to be a tube shape.

Figure 4:
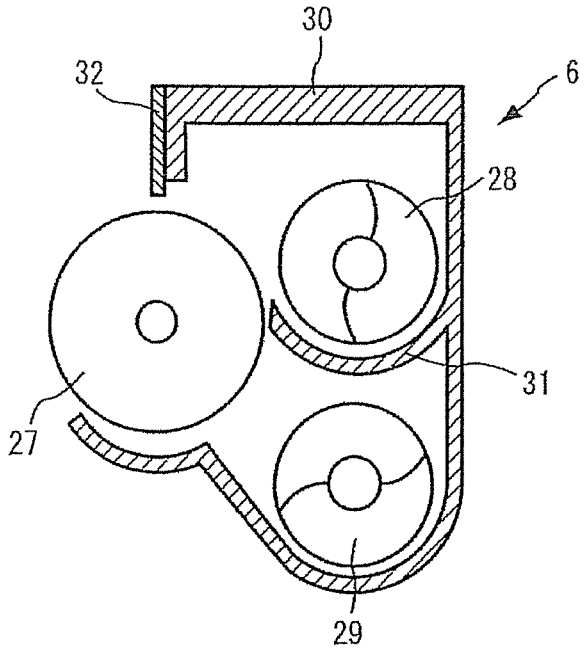
FIG. 4 illustrates a front view of a developing part used in the first embodiment.

As illustrated in FIG. 4, the developer part 6 includes a developing roller 27 and two conveyance screws 28 and 29 as a developer carrier in a casing 30. A magnet is provided inside the developing roller 27. This configuration is well known in which the developer is suctioned and carried so that the toner is adhered to the electrostatic latent image formed on the surface of the photosensitive drum 4. The conveyance screw 28, which is regarded as a developer supply member, is driven to rotate to carry the developer from a front to a rear thereof in FIG. 4. The conveyance screw 29, which is regarded as a developer collection member, is driven to rotate so as to carry the developer from a rear to a front thereof. A divider 31 is provided to divide the inside of the casing 30 into two spaces. The screws 28 and 29 are arranged respectively in the two spaces. The developing roller 27 and the conveyance screws 28 and 29 are driven to rotate by a motor (not shown) through a drive propagation mechanism (not shown).

Figure 5:
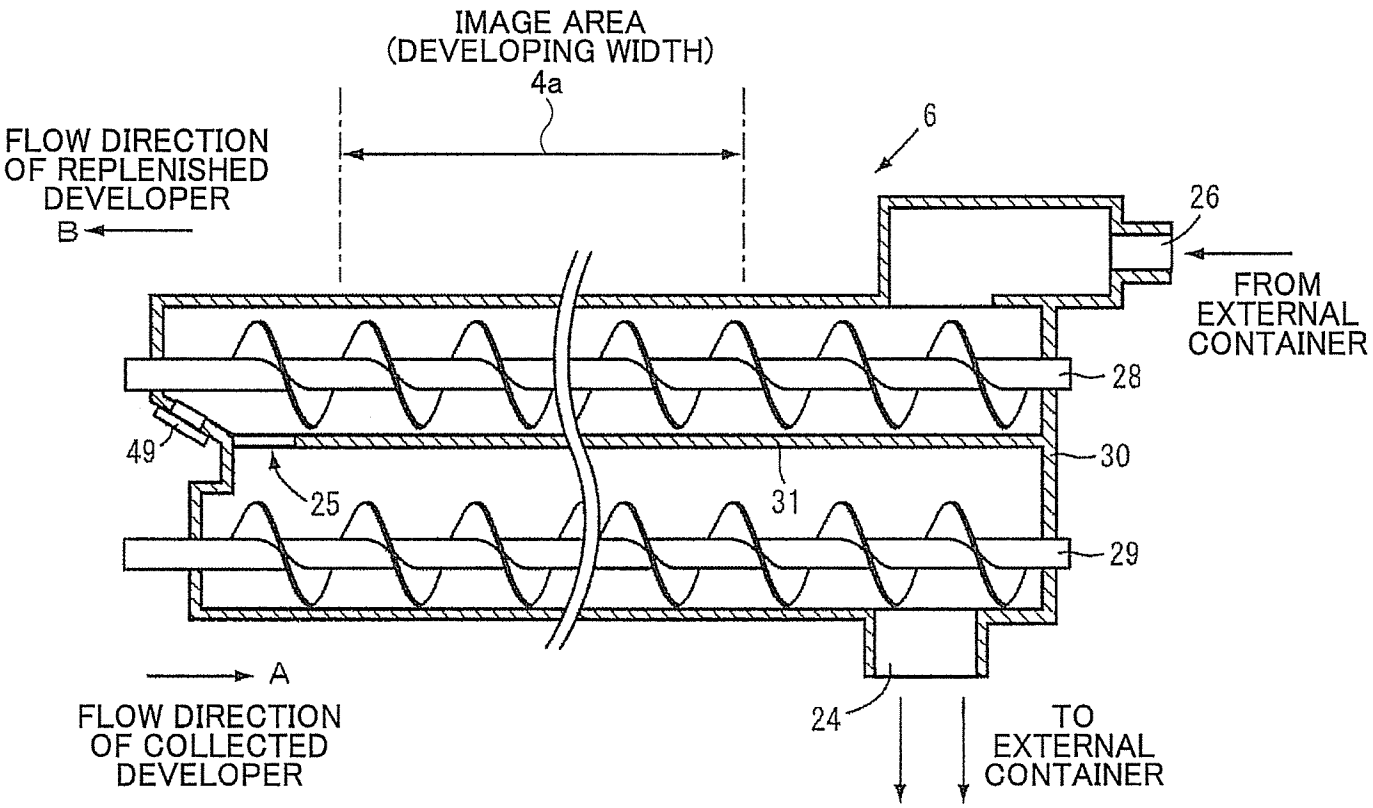
FIG. 5 illustrates a first configuration of the developing part in the first embodiment.

As illustrated in FIG. 5, the divider 31 includes an opening 25 at a rear end thereof (FIG. 4), and is formed so that the developer is moved from the conveyance screw 28 toward the conveyance screw 29. A supply opening 26 of the developer is provided at an edge of a front side in FIG. 4. In the casing 30 positioned at a vicinity of a peripheral surface of the developer roller 27, a doctor blade 32 is arranged to regulate the developer attached to the developing roller 27 in a certain amount.

Figure 6:
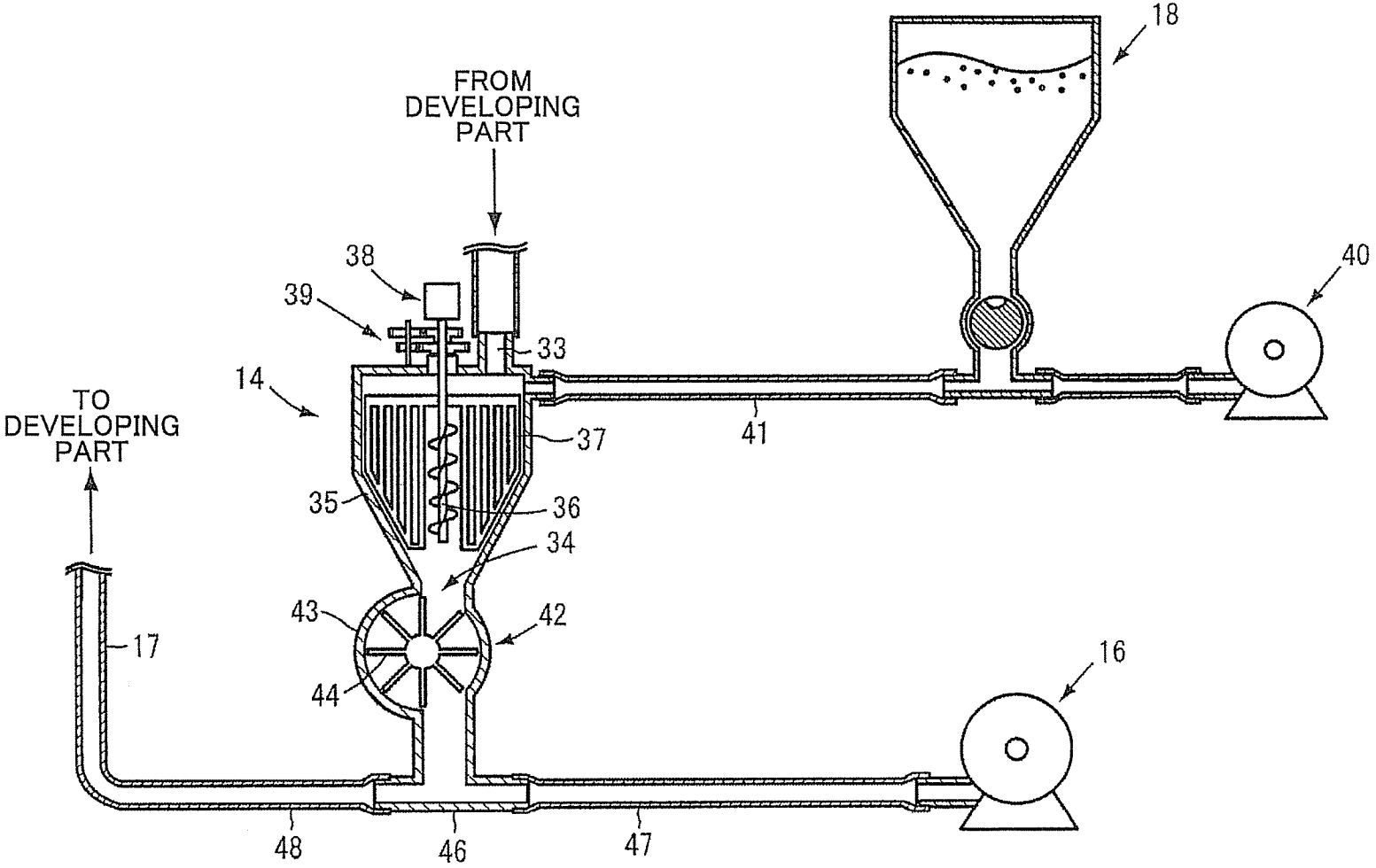
FIG. 6 illustrates a schematic view of a developer stirring part used in the first embodiment.

As illustrated in FIG. 3 and FIG. 6, in the developer stirring part 14, a casing 35 is provided to contain the developer and have a shape in which a diameter becomes narrower toward a bottom. A developer replenishing opening 33 is provided at an upper portion of the casing 35 and an ejection opening 34 is provided at a lower portion of the casing 35. Inside the casing 35, a screw 36 is provided to carry the developer from down to up, and a pair of stirring members 37 is rotatably provided. The screw 36 is arranged at a center position of the casing 35. The stirring members 37 are symmetrically arranged outside the screw 36. The screw 36 and the stirring members 37 are alternately rotated. Thus, the developer in the casing 35 is mixed.

The screw 36 and the stirring members 37 are driven and rotated by a motor 38 regarded as the developer conveyance part. The screw 36 is connected to the motor 38, and each of the stirring members 37 is decelerated and rotated via a deceleration gear sequence formed by multiple gears 39. The developer is carried due to gravity from a developer replenishing opening 33 to the ejection opening 34. Thus, the developer is always in the developer stirring part 14. That is, a non-mixed developer may not be ejected. The developer pumped upward from a bottom by a rotation of the screw 36 is transferred downward along rotations of the stirring members 37 which rotate outside the screw 36, and is collected around the screw 36, again. As described above, the developer is always circulated in the casing 35. By circulating the developer, the entire developer inside the casing 35 is uniformly mixed.

Also, in the first embodiment, the two-component developer is applied. Since a charge of the toner is applied by friction with the carrier, it is important to improve contact efficiency between the toner and the carrier in order to rapidly acquire a charge amount. By investigations of the inventors of the present invention, it is proved that the contact efficiency inside the casing 35 is improved by circulating the developer and a problem related to the developer occurs less. The new toner is replenished by the toner hopper 18 to the casing 35 based on consumption of the toner. That is, the motor 40 is driven to rotate a conveyance screw of a small size (not shown) arranged in a toner supply path 41 and the new toner in the toner hopper 18 is carried into the casing 35. The conveyance screw of the small size (not shown) is formed capable of carrying a certain amount of the new toner contained in the toner hopper 18 by being rotated. A replenished amount of the new toner is determined by a control part (not shown) depending on a detection result of a toner density sensor (not shown) which is attached near the most downstream position in a flow direction of a collected developer in the conveyance screw 29.

Below the developer stirring part 14, as illustrated in FIG. 6, a rotary re-feeder 42 is arranged as the developer conveyance part to be communicated to the casing 35. The rotary re-feeder 42 includes a function for ejecting a certain amount of the developer from the casing 35. The rotary re-feeder 42 includes a casing 43 and a blade wheel 44 rotatably provided in the casing 43. The certain amount of the developer is ejected downward by the blade wheel 44 being rotated by the motor 45 illustrated in FIG. 3.

A confluence part 46 is provided downward of the blade wheel 44. The confluence part 46 is connected to an air path 47 connected to a supply opening of the air pump 16 and an entrance part 48 regarded as one end of the developer conveyance path connected to the developing part 6. The developer of the certain amount ejected by the blade wheel 44 is carried by the air conveyance from the air pump 16 to the developing part 6. That is, the developer of the certain amount ejected from the rotary re-feeder 42 is returned to the developing part 6 by air pressure supplied by the air pump 16 inside the developer conveyance path 17. The developer conveyance path 17 is formed to be a tube shape by a material such as silicon or the like.

Figure 7:
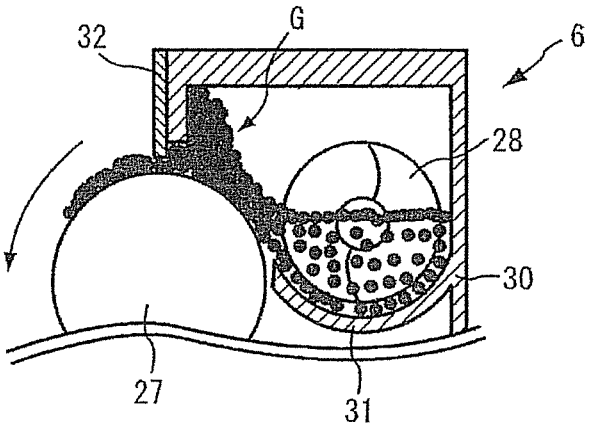
FIG. 7 illustrates a schematic view of a flow of developer in the first embodiment.

As illustrated in FIG. 5, a developer G (FIG. 7) having inflowed from the supply opening 26 via the developer conveyance path 17 is carried in a flow direction B of the replenished developer by the conveyance screw 28, and also is supplied to the developing roller 27 while a thickness is regulated by the doctor blade 32 as illustrated in FIG. 7. The developer (excess developer) which is not supplied to the developing roller 27 falls into the conveyance screw 29 from the opening 25 illustrated in FIG. 5. The conveyance screw 29 receives the collected developer carried from the conveyance screw 28 and carries the collected developer in a flow direction A of the collected developer. The collected developer is ejected from an ejection part 24 and is transferred to the developer stirring part 14 through the developer ejection flow path 15.

Features of the present invention will be described. First, a volume of the developer in the developing part 6 will be described. In the developing part 6 of a one direction circulation method as illustrated in FIG. 5, since the developer is consumed in accordance with the flow direction B from an upstream side to a downstream side in the conveyance screw 28, a volume of the developer becomes less from the upstream to the downstream. On the other hand, in the conveyance screw 29, the volume of the developer becomes more toward the upstream side in the flow direction A (limited in an area of the developing width) Accordingly, if the developer comes to have a shortage at the downstream in the flow direction A in the conveyance screw 29, a depletion state occurs in the conveyance screw 29. As a result, the developer may not be supplied to the developing roller 27.

In order to prevent the above-described problem, in general, the developer is excessively supplied not to be depleted. However, in the first embodiment, the developer is carried by the air conveyance from outside of the developing part 6. Thus, a conveyance amount may fluctuate depending on a state of the developer (a toner density, an environmental condition, deterioration state, and the like). If the conveyance amount decreases, the depletion state may occur. The occurrence of the depletion state is prevented by detecting the decrease of the conveyance amount beforehand. It is effective to detect the volume of the developer in a vicinity of the conveyance screw 28. As described in BACKGROUND OF THE INVENTION, a powder surface of the developer may not be accurately comprehended. However, a presence or an absence of the developer is easily detectable in a digital method (in a binary method), and may be accurately comprehended. In a first configuration in the first embodiment for a method for detecting the depletion state beforehand by a binary method, as illustrated in FIG. 5, a sensor 49 is arranged as a developer detection part at a downstream position near the opening 25 in the flow direction B. As the sensor 49, a piezoelectric sensor using a piezoelectric element, a magnetic permeability sensor for detecting a magnetic permeability of the developer, an electrostatic capacity sensor, and the like are usable.

Figure 8:
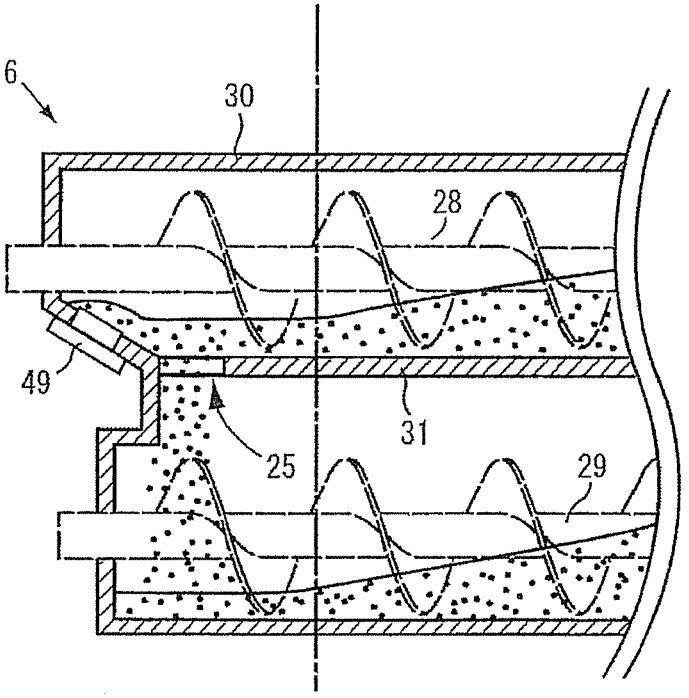
FIG. 8 illustrates a schematic view for explaining a behavior of the developer in the developing part in the first embodiment.
Figure 9:
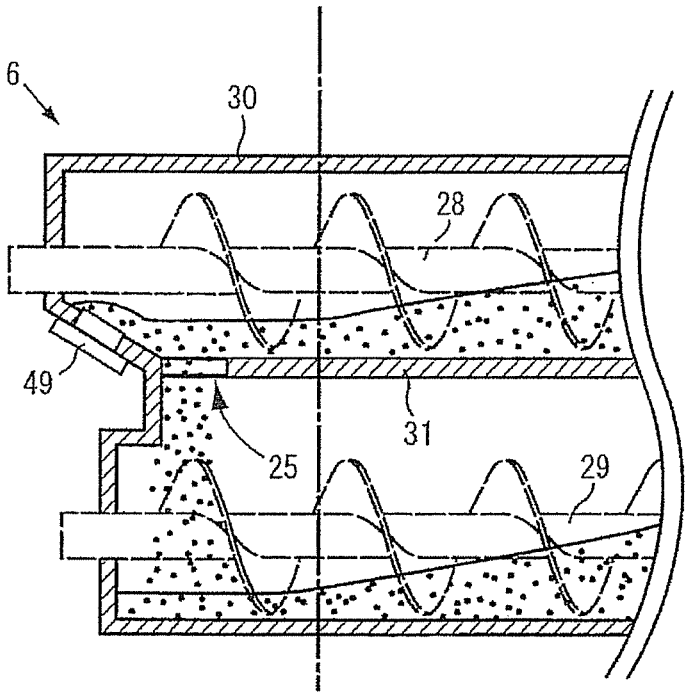
FIG. 9 illustrates the behavior of the developer in the developing part in the first embodiment.

An image area (developing width) 9*a* is regarded as an area in which the developer is required and the depletion state is not to be detected beforehand. The sensor 49 is set at a position in an area excluding the image area and areas other than the image area in which the depletion state is not detectable when the developer on the sensor 49 is exhausted. The sensor 49 is positioned in the area in which the occurrence of the depletion state is surely detectable when the developer on the sensor 49 is exhausted. FIG. 8 illustrates a state in which the depletion of the developer does not occur, and FIG. 9 illustrates a state in which the conveyance amount of the developer decreases (the depletion of the developer may occur).

In a state illustrated in FIG. 8, a portion of excess developer falls from the opening 25. Another portion of the excess developer is carried over the opening 25 and moves an end of the conveyance screw 28, and is detected by the sensor 49. In a case in which the conveyance amount of the developer is gradually decreased, a method for detecting the depletion state beforehand will be described. When the conveyance amount of the developer is decreased, an amount of the excess developer is decreased, and all excess developer falls through the opening 25. In this case, the developer does not exist on the sensor 49. The sensor 49 outputs information indicating that no developer exists. When the developer further decreases and the depletion occurs, it is possible to comprehend a decrease state of the developer before the depletion occurs.

By the above-described simple configuration, it is possible to certainly detect the occurrence of the depletion state of the developer. When it is detected based on a detection result of the sensor 49 that the developer does not exist in a vicinity of the conveyance screw 28, it is possible to control the conveyance amount of the developer toward the developing part 6 by the developer conveyance part. That is, by increasing an air supply amount of the air pump 16, a number of rotations of the motor 38, a rotation of the rotary re-feeder 42, and the like, a developer amount is increased to carry to the developing part 6. Accordingly, it is possible to stably and successively supply the developer surely to the developing roller 27, and it is possible to successively perform a preferable image formation. In the above-described configuration, as illustrated in FIG. 5, FIG. 8, and FIG. 9, the sensor 49 is arranged to incline toward the opening 25. Since the developer on the sensor 49 falls through the opening 25 by gravity when the developer decreases, it is possible to prevent a detection error due to residual developer on the sensor 49. Accordingly, a state in which the developer does not exist becomes surely detectable.

Figure 10:
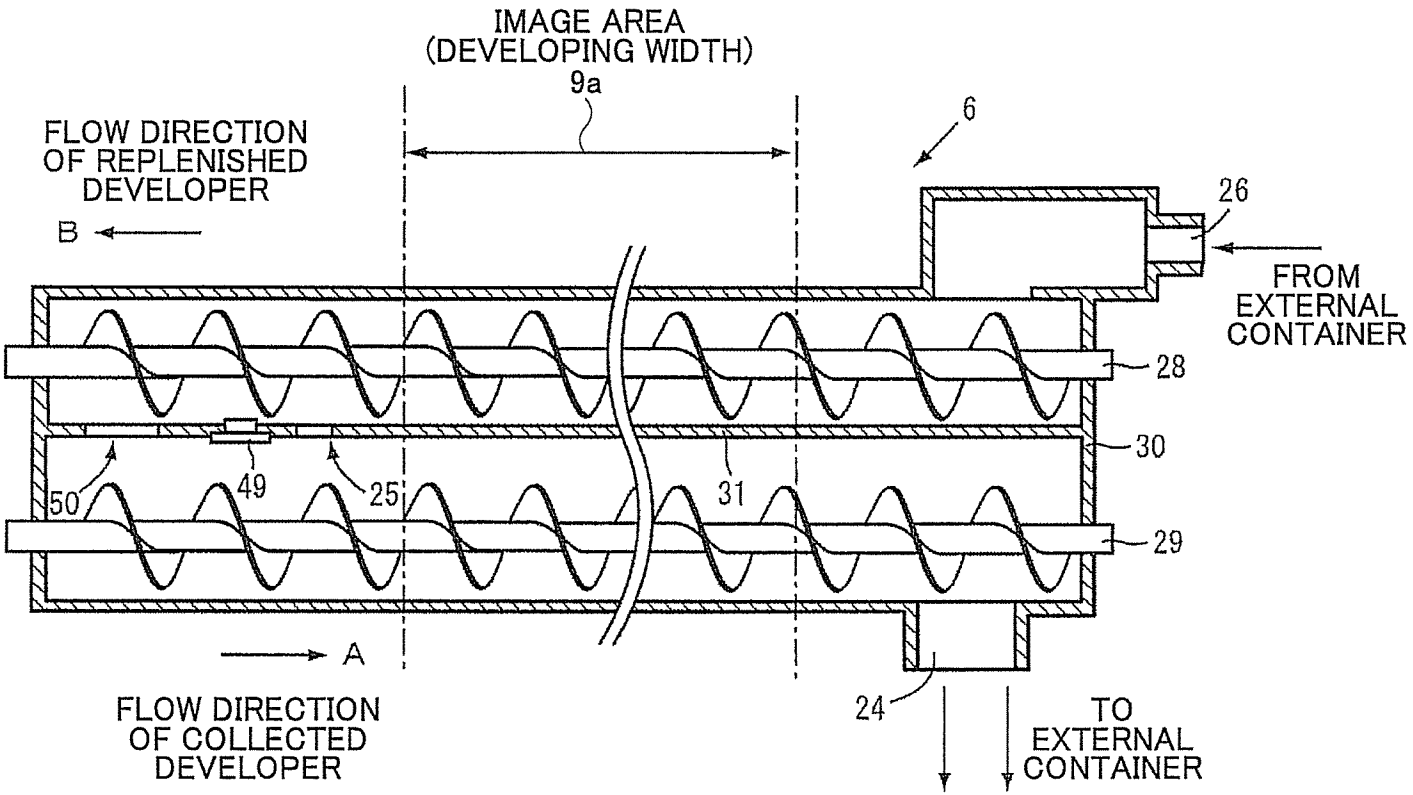
FIG. 10 illustrates a second configuration of the developing part in the first embodiment.
Figure 11:
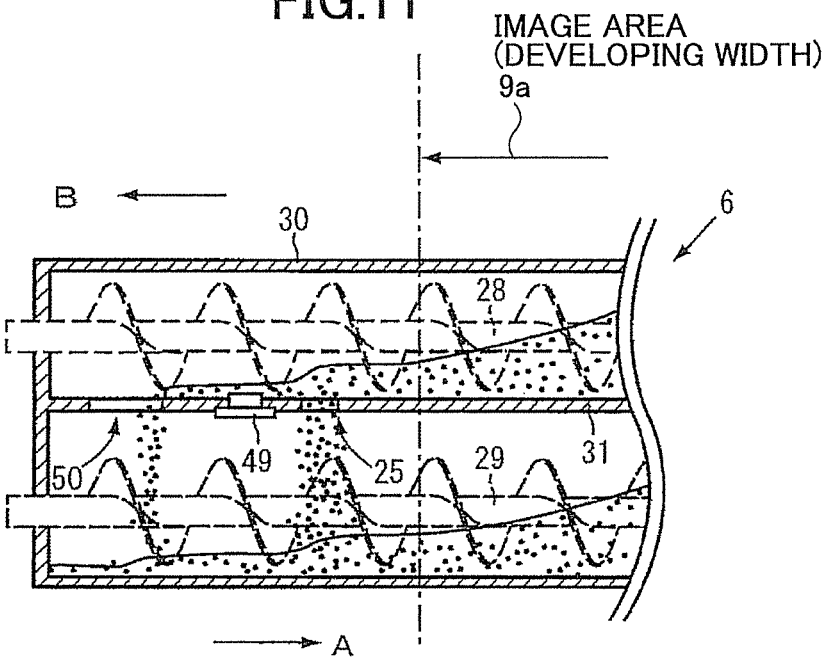
FIG. 11 illustrates a schematic view for explaining a behavior of developer in the second configuration in the first embodiment.
Figure 12:
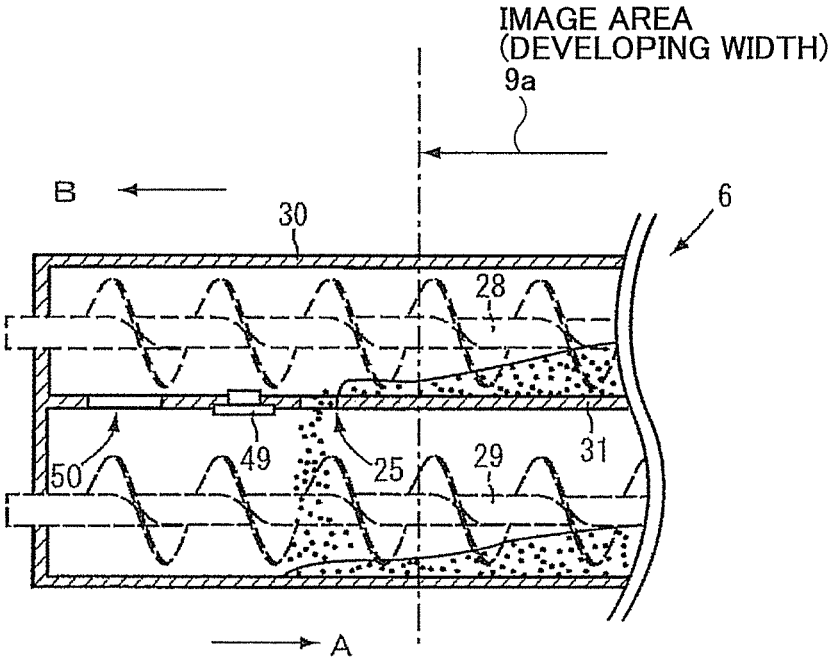
FIG. 12 illustrates a schematic view for explaining the behavior of the developer in the second configuration in the first embodiment.

FIG. 10 illustrates a second configuration in the first embodiment. In the second configuration, a second opening 50 is provided at a position downstream more than the sensor 49 in the flow direction B of the replenished developer for the conveyance screw 28. In the second configuration, FIG. 11 illustrates a state in which the depletion does not occur, and FIG. 12 illustrates a state in which the conveyance amount of the developer decreases (the depletion may occur soon). In the state illustrated in FIG. 11, a portion of the excess developer falls from the opening 25. The residual developer is carried to a side of the sensor 49, and further falls from the opening 50 to the conveyance screw 29. As illustrated in FIG. 12, when the conveyance amount of the developer becomes even less, the developer falls only from the opening part 25. Then, no developer exists on the sensor 49. In this configuration, when it is detected that the developer does not exist in the vicinity of the conveyance screw 28 based on the detection result of the sensor 49, by increasing the developer amount carried to the developing part 6, it is possible to acquire an effect similar to the first configuration.

In the second configuration, an area of the opening 25 may be formed to have a size for the excess developer to pass (fall) so that the developer, which is assured as an additional amount with respect to the conveyance amount (flow amount) of the developer being a depletion lower limit, is retained in the developing part 6. It is assumed that when a regular conveyance amount of the developer is 100 g/sec, the depletion lower limit (essential amount to develop an image) of the developer is 80 g/sec, and the conveyance amount of the developer assured as the additional amount is 10 g/sec, an area of the opening 25 is formed to be an area for the developer of 10 g/sec to pass. Also, the sensor 49 is formed to output information indicating that no developer exits when the conveyance amount of the developer becomes less than 90 g/sec. In detail, in a case in which the conveyance amount of the developer is 100 g/sec (the excess developer of 20 g/sec), the developer of 10 g/sec falls from the opening 25 and the residual developer of 10 g/sec passes on the sensor 49 and falls from the second opening 50, and the conveyance amount of the developer is 90 g/sec (the excess developer of 10 g/sec), the developer of 10 g/sec falls from the opening 25. Thus, the developer is not carried onto the sensor 49, and the sensor 49 outputs the information indicating that the developer does not exist. As described above, the area of the opening 25 is formed to retain the additional amount with respect to the conveyance amount of the developer, which is nearly the depletion state, in the developing part 6. It is possible to accurately set the additional amount in the conveyance amount of the developer and to certainly detect the occurrence of the depletion state of the developer.

Figure 13:
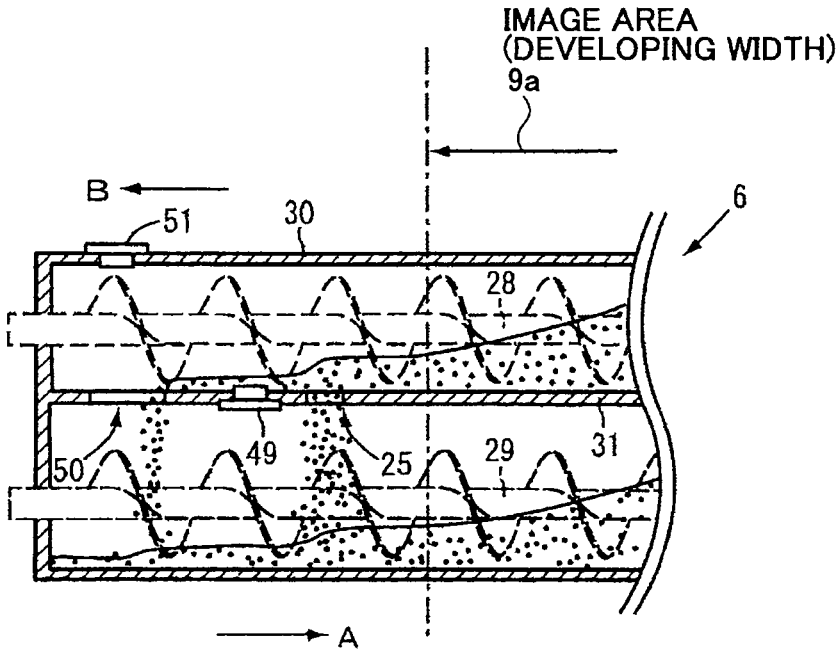
FIG. 13 illustrates a variation of the second configuration of the developing part in the first embodiment.

FIG. 13 illustrates a variation of the second configuration. In the variation, different from the second configuration, at a position which is in a vicinity and above the conveyance screw 28 and is opposite to the second opening 50, a sensor 51 is provided as a second developer detection part for detecting whether the developer exists in the vicinity of the conveyance screw 28. Each of the first and second configurations is regarded to correspond to the problem caused in a case in which the conveyance amount of the developer decreases. However, if the conveyance amount increases, the developer does not drop well from the opening 25 and the second opening 50, and the developer may clog an end of the conveyance screw 28. In a case in which the developer clogs the end, a conveyance of the developer by the conveyance screw 28 may create a problem. Not only a malfunction of the imaging operation may occur but also the developing part 6 may have an error. In this case, since the developer contacts the sensor 51, it is possible to detect the occurrence of the above problem beforehand. In a case of detecting the developer by the sensor 51, by decreasing the air supply amount of the air pump 16, the rotation of the motor 38, the rotation of the rotary re-feeder 42, and the like, the developer amount, which is to be carried to the developing part 6, is decreased. Accordingly, it is possible to successively conduct the preferable image formation.

In the first embodiment, a color printer is exemplified as the image forming apparatus. The image forming apparatus to which the first embodiment is applied is not limited to the color printer. Also, the first embodiment is applicable for a copier, a plotter, a facsimile machine, a multi-functional apparatus including these functions, and the like.

According to the first embodiment, it is possible to certainly detect the depletion of the developer by the above-described simple configuration. Also, it is possible to provide the developing device realizing a stable conveyance amount of the developer.

According to the present invention, it is possible to certainly detect the occurrence of the depletion state of the developer by the above-described simple configuration. By controlling the conveyance amount of the developer carried by the developer conveyance part to the developing part based on a detection result of the developer detection part, it is possible to certainly and successively conduct a stable supply of the developer for the developer carrier and realize successively performing the preferable image formation.

In the following, the developing device according to a second embodiment will be described. An image forming apparatus, in which the developing device according to the second embodiment is applicable, may be the same as the image forming apparatus 1 in FIG. 2. In the second embodiment, the components that are the same as those in the first embodiment are indicated by the same reference numerals and the explanation thereof will be omitted.

Figure 14:
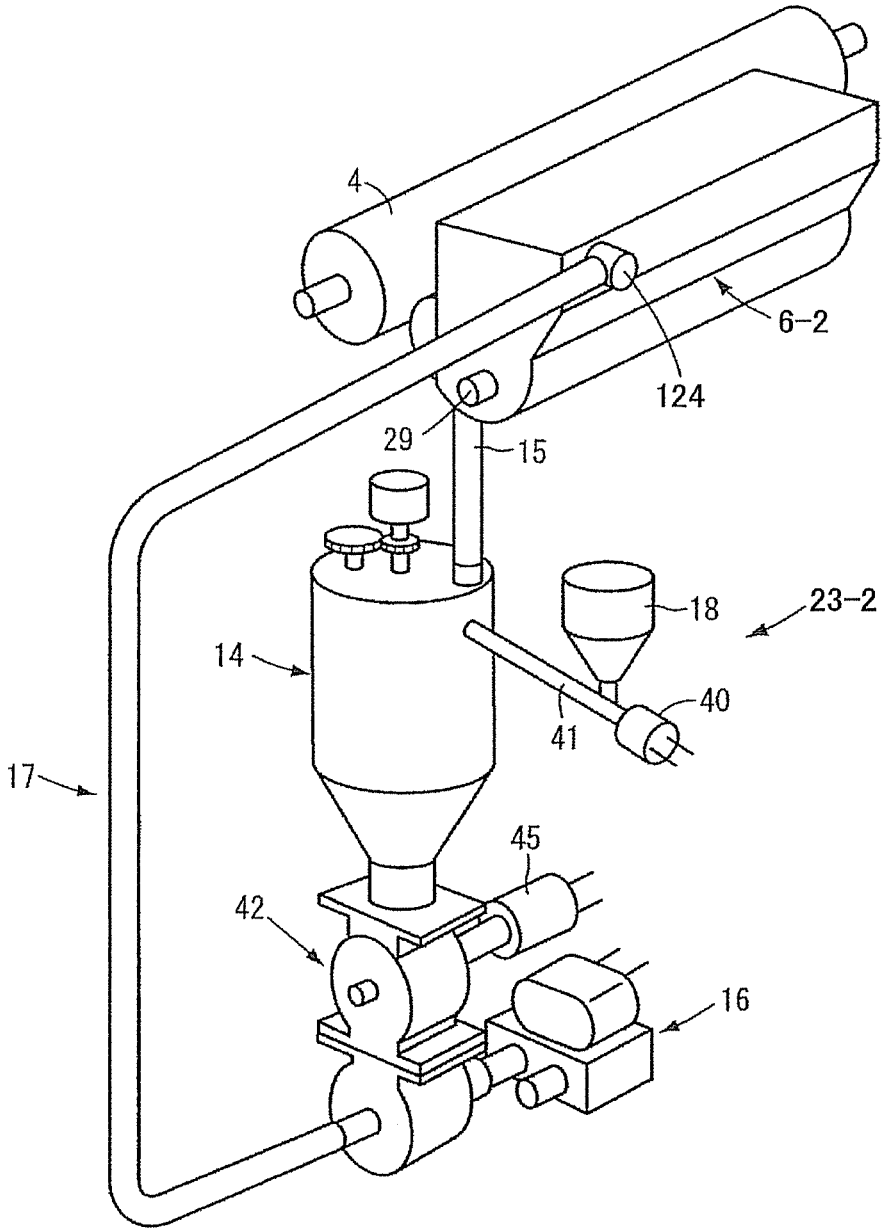
FIG. 14 illustrates a schematic perspective view of a developing device according to a second embodiment.

FIG. 14 illustrates a schematic perspective view of a developing device 23-2 according to the second embodiment. The developing device 23-2 includes a developing part 6-2 being oppositely arranged in a vicinity of the photosensitive drum 4, and the developer stirring part 14 arranged separately from the developing part 6-2. The developer is carried from the developer stirring, part 14 to the developing part 6-2 through the developer conveyance path 17 and a developer feed hole 124. The two-component developer in which the toner and the carrier are mixed may be used as the developer.

The developer is carried by air conveyance from the developer stirring part 14 and is supplied to the developing part 6-2 from the developer feed hole 124. The developer falls by gravity in the developer ejection flow path 15 connecting the developing part 6-2 and the developer stirring part 14 and returns to the developer stirring part 14. Thus, the developer is circulated between the developing part 6-2 and the developer stirring part 14. The developer ejection flow path 15 is formed by a flexible member such as a silicone tube or the like to be tubular in shape.

Figure 15:
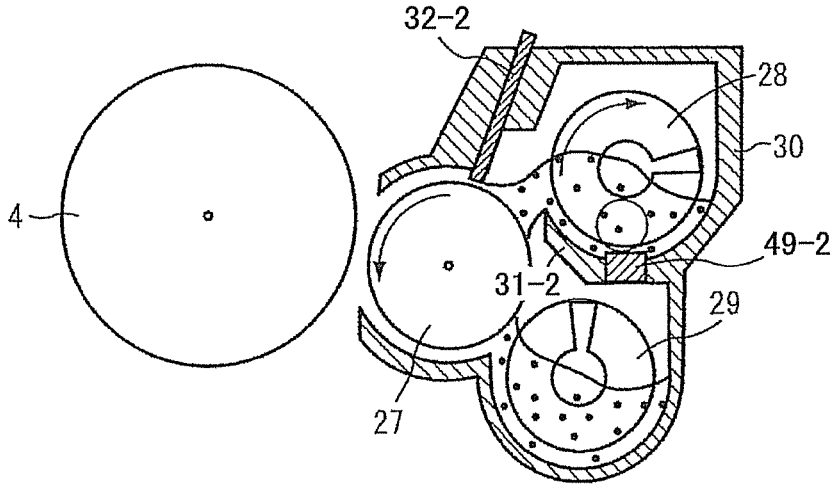
FIG. 15 illustrates a schematic front view of a developing part used in the second embodiment.

As illustrated in FIG. 15, the developing part 6-2 includes the developer roller 27 and the two conveyance screws 28 and 29 as the developer carrier. The developer roller 27 includes a magnet inside, and the developer is adhered to and conveyed by the developing roller 27. The toner is adhered to an electrostatic latent image formed on a surface of the photosensitive drum 4. The conveyance screw 28, which is regarded as the developer supply member, is driven to rotate to carry the developer from a front to a rear thereof as illustrated in FIG. 15. The conveyance screw 29, which is regarded as the developer collection member, is driven to rotate so as to carry the developer from a rear to a front thereof. A divider 31-2 is provided to divide the inside of the casing 30 into two spaces. The conveyance screws 28 and 29 are arranged respectively in the two spaces. The developing roller 27 and the conveyance screws 28 and 29 are driven to rotate by a motor (not shown) through a drive propagation mechanism (not shown).

Figure 16:
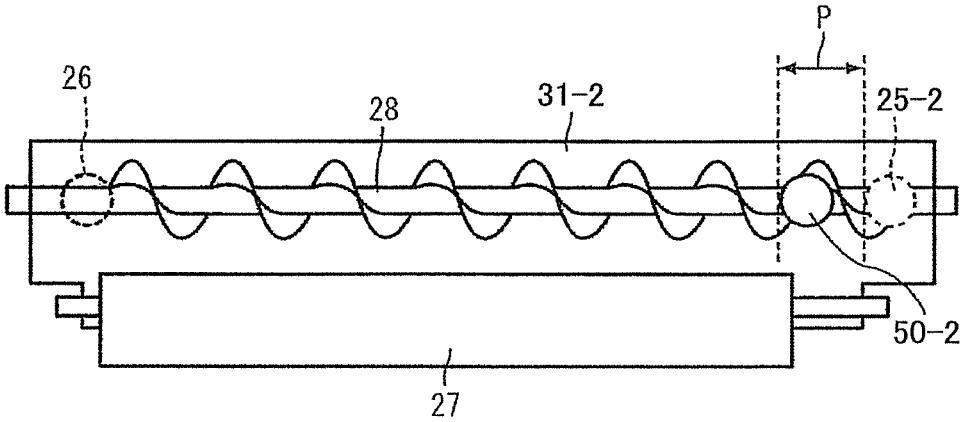
FIG. 16 illustrates a schematic perspective view of the developing part used in the second embodiment.

As illustrated in FIG. 16, the divider 31-2 includes an opening 25-2 at a rear end thereof (FIG. 16), and is formed so that the developer is moved from the conveyance screw 28 toward the conveyance screw 29. The developer is carried toward the conveyance screw 29 from the conveyance screw 28. The supply opening 26 of the developer is provided at an edge of a front side in FIG. 16. In the casing 30 positioned at the vicinity of the peripheral surface of the developer roller 27, the doctor blade 32-2 is arranged to regulate the developer attached to the developing roller 27 to the certain amount.

Figure 17:
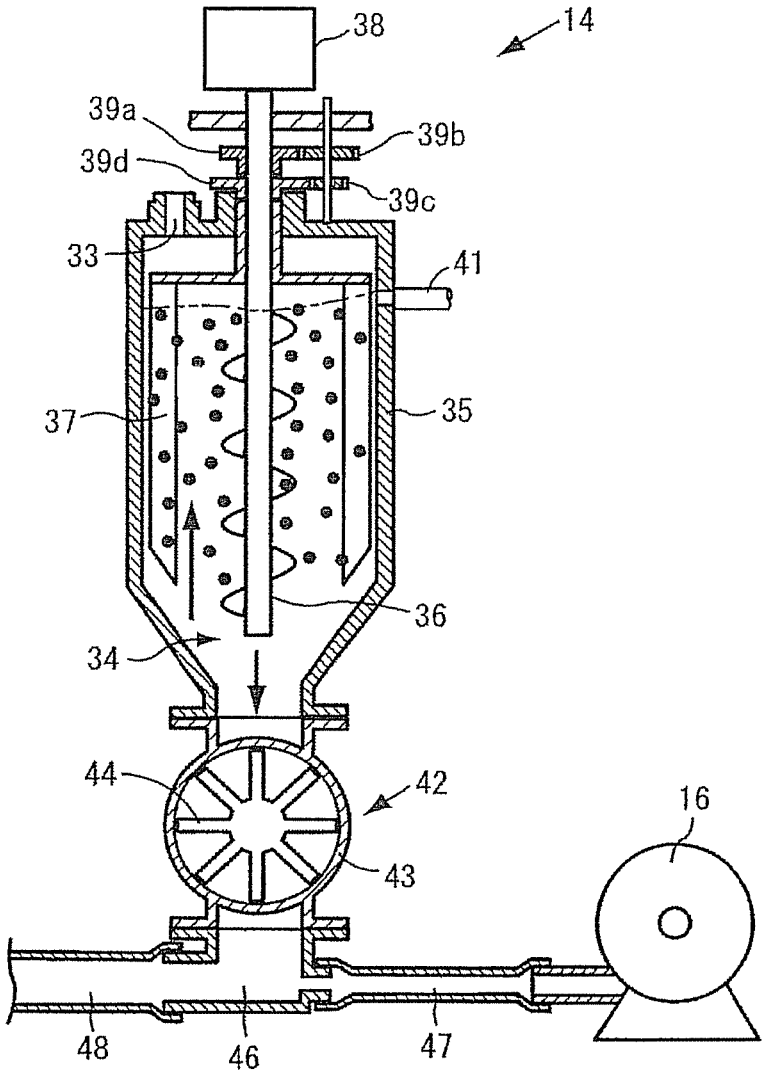
FIG. 17 illustrates a schematic view of a developer stirring part used in the second embodiment.

As illustrated in FIG. 14 and FIG. 17, in the developer stirring part 14, a casing 35 is provided to contain the developer and have a shape in which a diameter becomes narrower toward a bottom. The developer replenishing opening 33 is provided at the upper portion of the casing 35 and the ejection opening 34 is provided at a lower portion of the casing 35. Inside the casing 35, a screw 36 is provided to carry the developer from down to up, and two stirring members 37 are rotatably provided. The screw 36 is arranged at the center position of the casing 35. The stirring members 37 are symmetrically arranged outside the screw 36. The screw 36 and the stirring members 37 are alternately rotated. Thus, the developer in the casing 35 is mixed.

The screw 36 and the stirring members 37 are driven and rotated by the motor 38 regarded as the developer conveyance part. The screw 36 is connected to the motor 38. Each of the stirring members 37 is decelerated and rotated via a deceleration gear sequence formed by multiple gears 39*a*, 39*b*, 39*c*, and 39*d*. The developer is carried due to gravity from the developer replenishing opening 33 to the ejection opening 34. Thus, the developer is always in the developer stirring part 14. That is, the non-mixed developer may not be ejected. The developer pumped upward from a bottom by a rotation of the screw 36 is transferred downward along rotations of the stirring members 37 which rotate outside the screw 36, and is collected around the screw 36, again. As described above, the developer is always circulated in the casing 35. By circulating the developer, the entire developer inside the casing 35 is uniformly mixed.

Also, in the second embodiment, the two-component developer is applied. Since a charge of the toner is applied by friction with the carrier, it is important to improve contact efficiency between the toner and the carrier in order to rapidly acquire a charge amount. By investigations of the inventors of the present invention, it is proved that the contact efficiency inside the casing 35 is improved by circulating the developer and a problem related to the developer occurs less. New toner is replenished by the toner hopper 18 (FIG. 14) to the casing 35 based on consumption of the toner. That is, the motor 40 is driven to rotate a conveyance screw of a small size (not shown) arranged in a toner supply path 41 and the new toner in the toner hopper 18 is carried into the casing 35. The conveyance screw of the small size (not shown) is formed capable of carrying a certain amount of the new toner contained in the toner hopper 18 by being rotated. A replenished amount of the new toner is determined by a control part (not shown) depending on a detection result of a toner density sensor (not shown) which is attached near the most downstream position in a flow direction of a collected developer in a conveyance screw 29.

Below the developer stirring part 14, as illustrated in FIG. 17, a rotary re-feeder 42 is arranged as a developer conveyance part to be communicated to the casing 35. The rotary re-feeder 42 includes a function for ejecting a certain amount of the developer from the casing 35. The rotary re-feeder 42 includes a casing 43 and a blade wheel 44 rotatably provided in the casing 43. The certain amount of the developer is ejected downward by the blade wheel 44 being rotated by the motor 45 illustrated in FIG. 14.

A confluence part 46 is provided downward of the blade wheel 44. The confluence part 46 is connected to an air path 47 connected to a supply opening of the air pump 16 and an entrance part 48 regarded as one end of the developer conveyance path connected to a developer feed hole 124 (FIG. 14). The developer of the certain amount ejected by the blade wheel 44 is carried by the air conveyance from the air pump 16 to the developer feed hole 124. That is, the developer of the certain amount ejected from the rotary re-feeder 42 is returned to the developing part 6-2 by air pressure supplied by the air pump 16 inside the developer conveyance path 17. The developer conveyance path 17 is formed to be a tube shape by a material such as silicon or the like.

Features of the present invention will be described. As illustrated in FIG. 15, a sensor 49-2 is arranged below and in a vicinity of the conveyance screw 28 as a powder surface detection part for detecting whether a height of the powder surface of the developer carried by the conveyance screw 28 is higher than a predetermined height. The sensor 49-2 detects the powder surface of the developer at a downstream in a flow direction of the developer by the conveyance screw 28. The sensor 49-2 is arranged at an area P illustrated in FIG. 16 between an end of the downstream in the flow direction of the developer and the opening 25-2 to which the excess developer drops toward the conveyance screw 29, in a region in which the conveyance screw 28 faces the developer roller 27. The sensor 49-2 is arranged lower than a rotation shaft of the conveyance screw 28, and detects the powder surface of the developer in an area 50-2. The magnetic permeability sensor for detecting the toner density is used as the sensor 49-2, and outputs a signal corresponding to a ratio of the carrier in the developer which exists above the sensor 49-2.

Figure 18A:
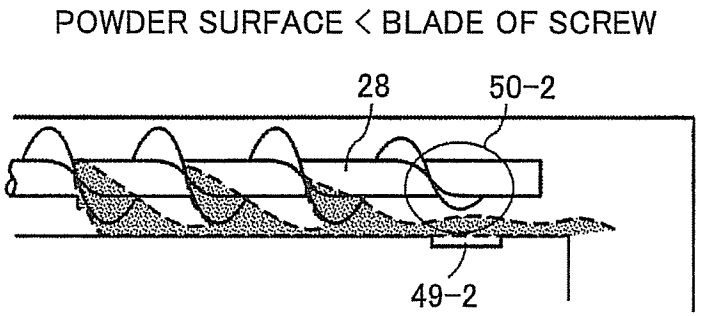
FIG. 18A through FIG. 18D illustrate a relationship between a height of a powder surface of the developer and an output value of a powder surface detection part in the second embodiment.
Figure 18B:
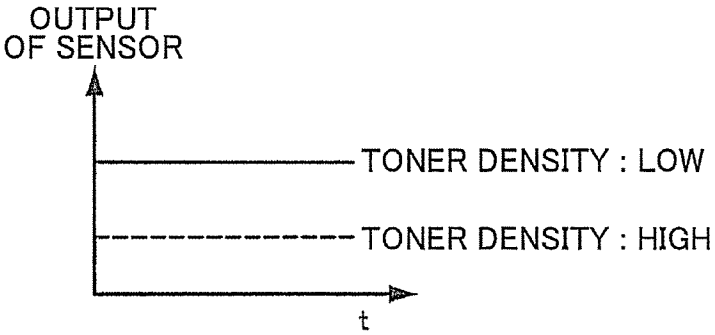
Figure 18C:
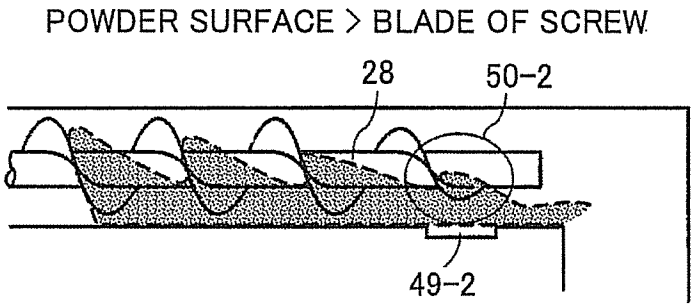
Figure 18D:
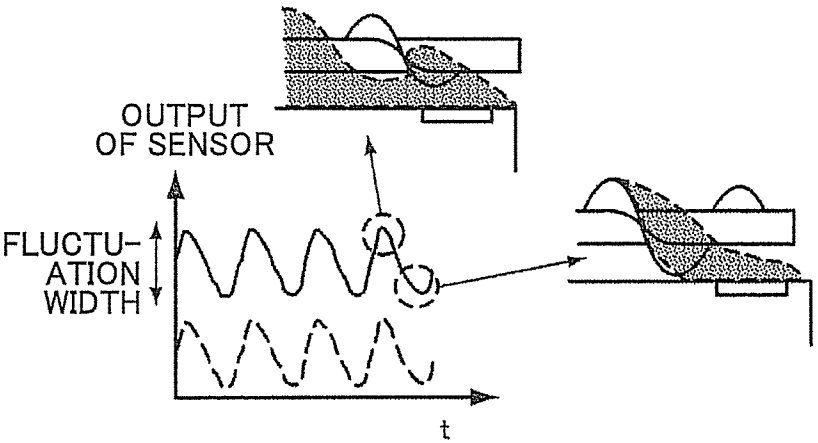

A relationship between the powder surface of the developer and the sensor 49-2 will be described with reference to FIG. 18A through FIG. 18D. FIG. 18A and FIG. 18C illustrate a relationship between the powder surface of the developer on the sensor 49-2 and a height of the blade of the conveyance screw 28. FIG. 18B and FIG. 18D illustrates a change of the output of the sensor 49-2. FIG. 18A illustrates a case in which the powder surface is positioned lower than the blade of the conveyance screw 28. In this case, since the powder surface does not contact the blade even if the conveyance screw 28 is rotated, the output of the sensor 49-2 becomes constant as illustrated in FIG. 18B. FIG. 18C illustrates a case in which the powder surface is positioned higher than the blade of the conveyance screw 28. In this case, since the developer is carried by the slope of the blade of the conveyance screw 28, the height of the powder surface changes with rotation of the conveyance screw 28. By the rotation of the conveyance screw 28, the power surface of the developer on the sensor 49-2 becomes the highest in height immediately before the blade passes on the sensor 49-2, and then becomes the lowest in height. Accordingly, the output of the sensor 49-2 fluctuates based on a screw rotation period as illustrated in FIG. 18A through FIG. 18D. In a case in which the magnetic permeability sensor is used as the sensor 49-2 as illustrated in the second embodiment, an output value changes depending on the toner density, but a fluctuation width based on the screw rotation period hardly depends on the toner density.

Figure 19:
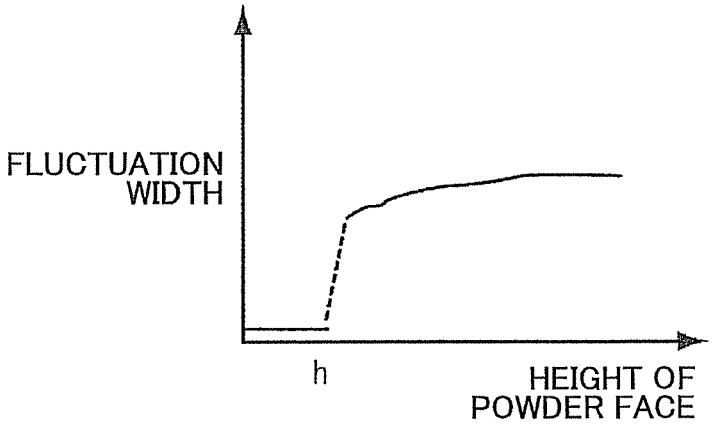
FIG. 19 is a graph illustrating a relationship between a fluctuation width of an output value of the powder surface detection part used in the second embodiment and the height of the powder surface of the developer.

FIG. 19 is a diagram illustrating a relationship between the height of the powder surface of the developer and the fluctuation width of the output value of the sensor 49-2. As illustrated in FIG. 19, when the height of the powder surface is lower so as not to contact the blade of the conveyance screw 28, the output value hardly changes and the fluctuation width may be zero. However, when the height of the powder surface becomes higher than a height h which may be equal to the blade of the conveyance screw 28, the output value of the sensor 49-2 starts fluctuating depending on the screw rotation period. The fluctuation width becomes greater in response to an increase of the height of the powder surface until the height of the powder surface exceeds a half screw diameter. Thus, based on the fluctuation width of the output value of the sensor 49-2, it is determined that the powder surface of the developer is higher than the blade of the conveyance screw 28. Even if the magnetic permeability sensor as the sensor 49-2 is used, the fluctuation width of the output value does not depend on the toner density. Thus, independent of the toner density, it is possible to determine that the height of the powder surface of the developer is greater than a reference value. In this detection method, even if the developer supply amount for the developing part 6-2 changes in response to the pulsation, it is possible to detect whether the developer carried with the conveyance amount of a lower limit value is retained at more than a predetermined height in the developing part 6-2.

By the above-described configuration, it is determined by the sensor 49-2 whether the height of the powder surface of the developer is greater than a predetermined height. The conveyance amount of the developer is controlled by controlling operations of the air pump 16 the motor 38, the rotary re-feeder 42, and the like as the developer conveyance part, so that the height of the powder surface is not lower than the predetermined height. Accordingly, it is possible to prevent the height of the powder surface of the developer becoming lower at the downstream side in the flow direction of the developer by the conveyance screw 28. Also, it is possible to assure a stable amount of the developer for the entire developer roller 27. Moreover, it is possible to successively perform preferable image forming operations.

Next, a setting method for setting the height of the powder surface of the developer which the sensor 49-2 detects will be described. A relationship between the height of the powder surface of the developer on the conveyance screw 28 and the supply amount (a pumped-up amount) of the developer toward the developing roller 27 may be investigated, and the lower limit value may be investigated. The lower limit value indicates the height of the powder surface in which the pumped-up amount becomes constant and the depletion of the developer does not occur on the developing roller 27. Next, a shape of the blade positioned above the sensor 49-2 is designed, so that a distance between the blade of the conveyance screw 28 and the divider 31-2 corresponds to the height indicated by the lower limit value. In a regular developing device, the distance between the blade of the conveyance screw 28 and the divider 31-2 is designed to be approximately 0.5 mm to 2.0 mm to assure the conveyance amount of the developer. In addition, in order to acquire a sufficient pumped-up amount of the developer, the height of the powder surface may be approximately ⅓ screw diameter. However, in a case in which the distance between the blade and the divider 31-2 in the entire conveyance screw 28 is expanded to ⅓ screw diameter, a conveyance effect of the conveyance screw 28 is unfavorably degraded.

Figure 20A:
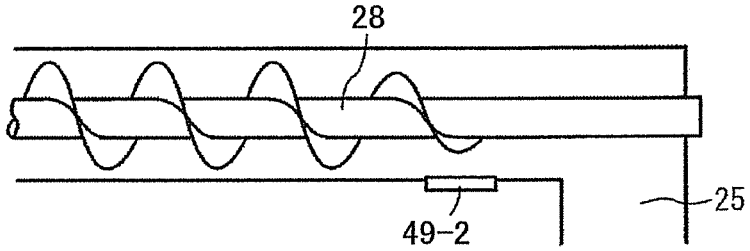
FIG. 20A and FIG. 20B illustrates schematic views of a conveyance screw used in the second embodiment.
Figure 20B:
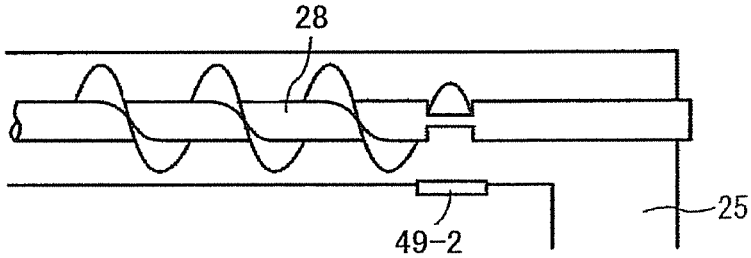

Accordingly, a distance between the blade of the conveyance screw 28 positioned above the sensor 49-2 and the divider 31-2 is expanded to ⅓ screw diameter, and a distance between the blade and the divider 31-2 at a upstream side of the flow direction of the developer is set to be 0.5 mm to 2.0 mm. FIG. 20A and FIG. 20B are diagrams illustrating a magnification of a vicinity of the sensor 49-2 of the conveyance screw 28. In FIG. 20A, an external diameter of the blade of the conveyance screw 28 positioned above the sensor 49-2 is formed to be smaller than that of a region at the upstream of the flow direction of the developer. In FIG. 20B, a shaft diameter of the conveyance screw 28 positioned above the sensor 49-2 is formed to be smaller than that of the region at the upstream of the flow direction of the developer. As described above, the distance between the blade of the conveyance screw 28 and the divider 31-2 is expanded, and the distance is set to be equal to or greater than the height which is the lower limit value so that the pumped-up amount of the developer becomes constant. The powder surface of the developer always contacts the blade of the conveyance screw 28 at a position corresponding to the sensor 49-2. Therefore, it is possible to prevent the occurrence of the depletion of the developer due to a shortage of the pumped-up amount of the developer at the downstream side of the flow distance of the developer by the developing roller 27. Also, it is possible to acquire a stable pumped-up amount at the downstream of the flow direction of the developer by the developing roller 27.

Next, a control method for controlling the conveyance amount of the developer toward the developing part 6-2 based on the fluctuation width of the output value of the sensor 49-2 will be described. The fluctuation width of the output value of the sensor 49-2 is detected based on the rotation period of the conveyance screw 28. If the powder surface of the developer is greater than the height of the blade of the conveyance screw 28, the output value of the sensor 49-2 fluctuates depending on the rotation period of the conveyance screw 28. Accordingly, the output value of the sensor 49-2 is monitored at the rotation period of the conveyance screw 28, and the fluctuation width is calculated based on its maximum value and minimum value. Thus, since the powder surface is detected within the shortest time, it is possible to timely increase the supply amount of the developer when the powder surface becomes lower.

Figure 21:
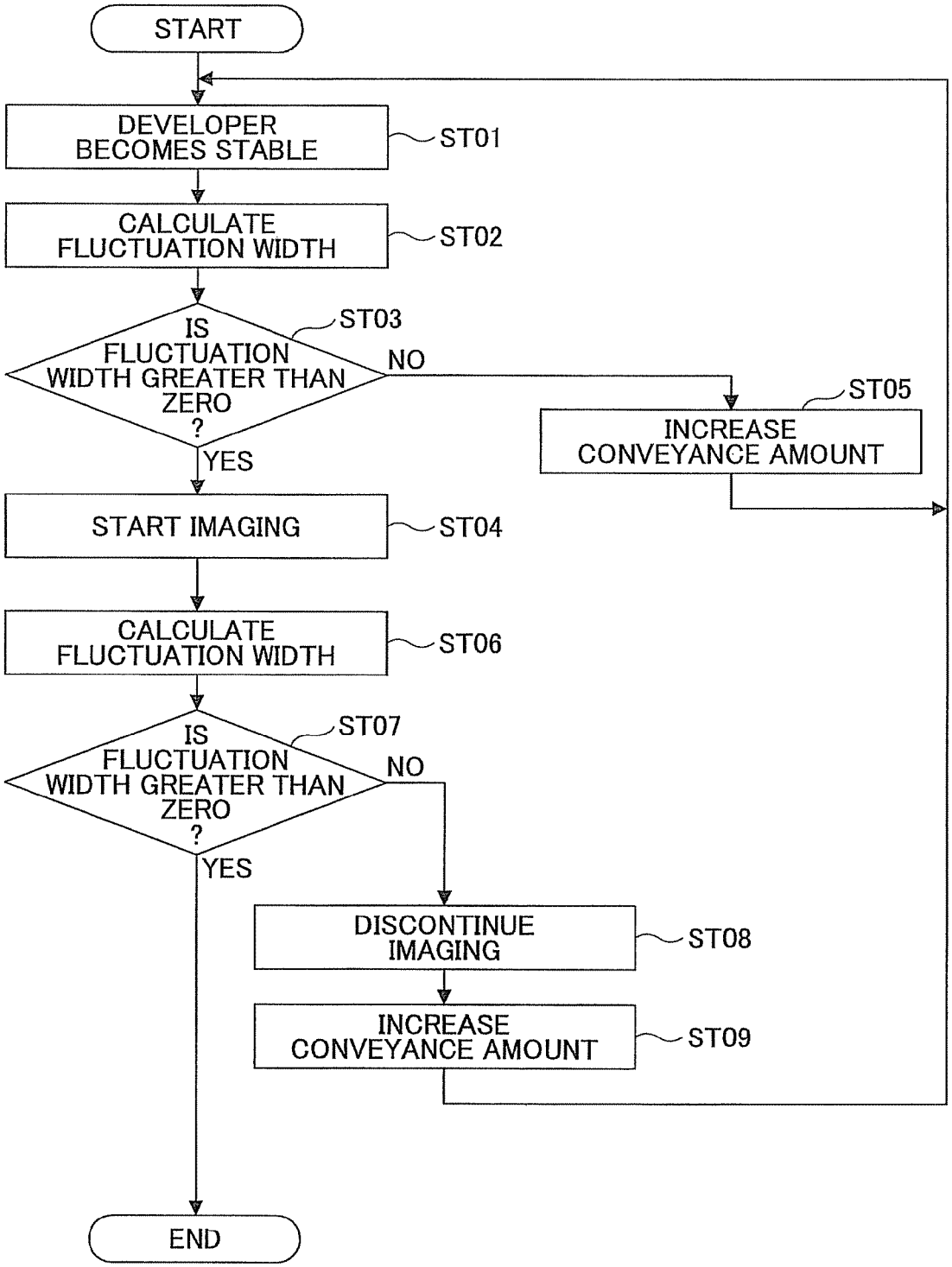
FIG. 21 is a flowchart for explaining a conveyance amount control for the developer in a case in which a reference value is set to be zero in the second embodiment.

A process flow from detecting the fluctuation width to controlling the fluctuation width will be described with reference to FIG. 21. In FIG. 21, the developing device 23-2 is activated and the developer is stably circulated (step ST01). Then, the output of the sensor 49-2 is monitored and the fluctuation width of the output value is calculated (step ST02). In the step ST02, the fluctuation width is measured ten times at the rotation period of the conveyance screw 28 and measured fluctuation widths are averaged. It is determined whether the fluctuation width is greater than zero (step ST03). When the fluctuation width is greater than zero, it is determined that the developer is normally circulated, and an imaging operation starts without changing the conveyance amount of the developer (step ST04). On the other hand, when the fluctuation width is equal to zero, it is determined that the conveyance amount of the developer is insufficient, and the conveyance amount of the developer is increased (step ST05). By increasing the air supply amount from the air pump 16 or the rotation of the rotary re-feeder 42, the conveyance amount of the developer is increased.

Figure 22:
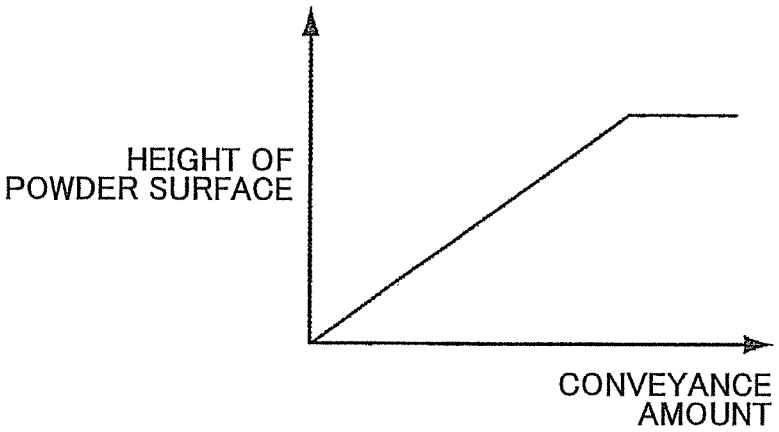
FIG. 22 is a graph illustrating a relationship between the height of the powder surface of the developer and a conveyance amount of the developer toward the developing part in the second embodiment.

The conveyance amount of the developer toward the developing part 6-2 and the height of the powder surface are in a proportional relationship as illustrated in FIG. 22. Thus, by increasing the conveyance amount of the developer, it is possible to increase the height of the powder surface of the developer in the vicinity of the conveyance screw 28. After the conveyance amount of the developer is increased, the developer is circulated for approximately 10 seconds until a circulation of the developer becomes stable. After that, the fluctuation width of the output value of the sensor 49-2 is calculated again (step ST06), and a value of the fluctuation width is confirmed (step ST07). When the fluctuation width is zero, the imaging operation is discontinued (step ST08). After that, the conveyance amount of the developer is increased, again (step ST09). The above-described steps are repeated until the fluctuation width becomes zero. When it is confirmed that the fluctuation width becomes positive, the imaging operation is started. The fluctuation width of the sensor 49-2 is always calculated even in the imaging operation when the developing device 23-2 is being operated. When the fluctuation width becomes zero, the imaging operation is discontinued and the conveyance amount is controlled to be increased. After the fluctuation amount becomes positive and it is confirmed that the conveyance amount is sufficiently acquired, the imaging operation is restarted.

Figure 23:
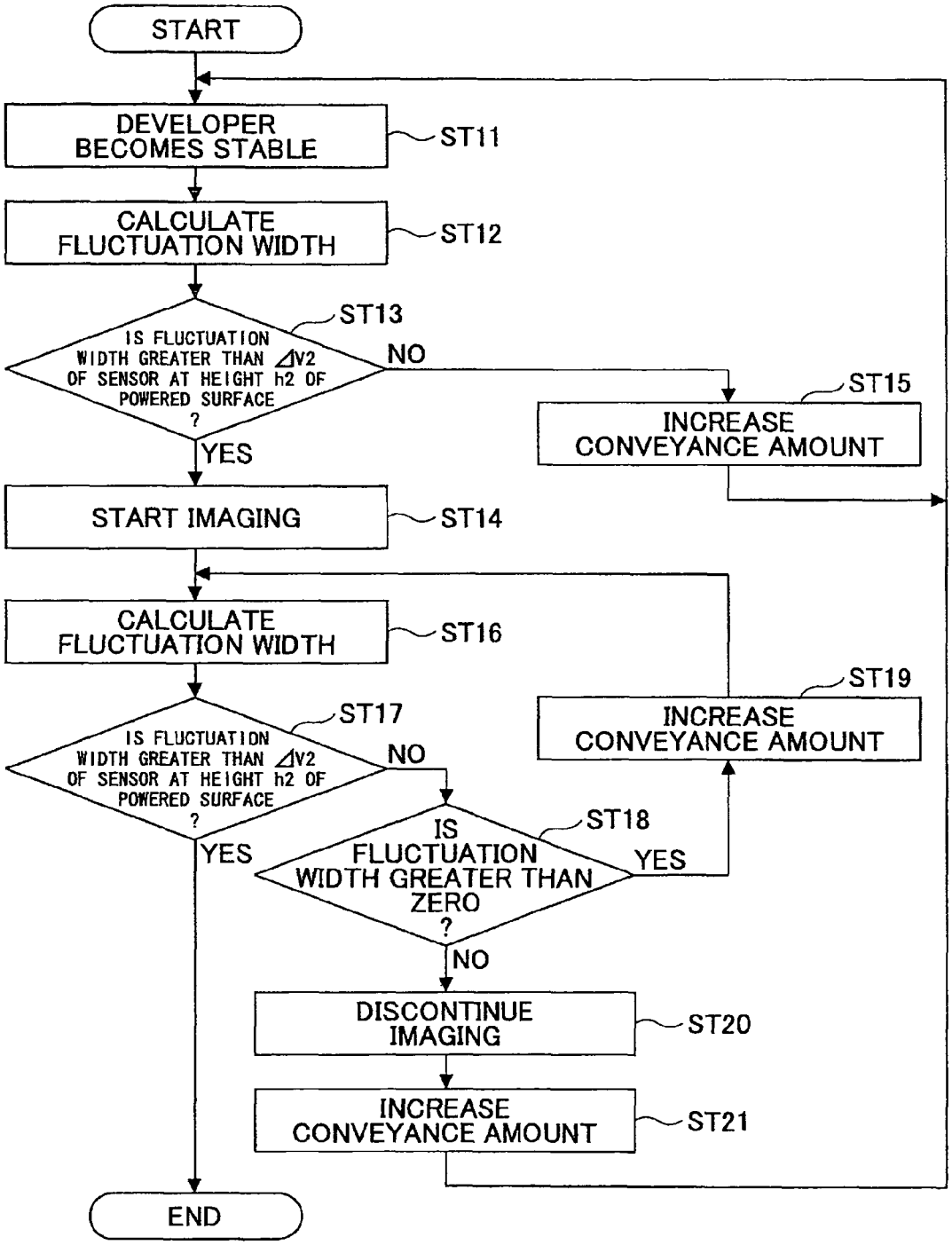
FIG. 23 is a flowchart for explaining the conveyance amount control for the developer in a case in which the reference value is set to be ΔV2 in the second embodiment.

In the above-described configuration, by setting the fluctuation width to be greater than the reference value, it is possible to prevent an occurrence of a defect in which the imaging operation is discontinued because of a decrease of the conveyance amount of the developer in the imaging operation. As the reference value, the height of the powder surface may be set to retain to be greater than the lower limit value in which the pumped-up amount is influenced. In the following, a conveyance amount control for the developer will be described with reference to FIG. 23 in a case in which a fluctuation width ΔV2 of the output value of the sensor 49-2 at a height h2 (h2>lower limit value) of the powder surface is used. FIG. 23 is a diagram illustrating a flowchart for explaining a conveyance amount control for the developer in the case in which the reference value is set to be ΔV2 in the second embodiment.

In FIG. 23, the developing device 23-2 is activated and the developer is stably circulated (step ST11). Then, the output of the sensor 49-2 is monitored and the fluctuation width of the output value is calculated (step ST12). In the step ST12, the fluctuation width is measured ten times at the rotation period of the conveyance screw 28 and measured fluctuation widths are averaged. It is determined whether the fluctuation width is greater than ΔV2 (step ST13). When the fluctuation width is equal to or greater than ΔV2, it is determined that the developer is normally circulated. Then, the imaging operation starts without changing the conveyance amount of the developer (step ST14). On the other hand, when the fluctuation width is less than ΔV2, it is determined that the conveyance amount of the developer tends to decrease. Then, the conveyance amount of the developer is increased (step ST15).

In a case in which the conveyance amount of the developer is increased, after the developer is circulated for approximately 10 seconds until being stable, the fluctuation width of the output value of the sensor 49-2 is calculated, again (step ST16), and a value of the fluctuation width is confirmed (step ST17). When the fluctuation width is less than ΔV2, it is determined whether the fluctuation width is greater than zero (step ST18). When the fluctuation width is positive, the conveyance amount of the developer is increased (step ST19). When the fluctuation width is zero, after the imaging operation is discontinued (step ST20), the conveyance amount of the developer is increased (step ST21). The above-described steps are repeated until the fluctuation width becomes positive. When it is determined that the fluctuation width becomes positive, the imaging operation starts. The fluctuation width of the sensor 49-2 is always calculated even in the imaging operation when the developing device 23-2 is being operated. When the fluctuation width becomes zero, the imaging operation is discontinued and the conveyance amount is controlled to be increased. After the fluctuation amount becomes positive and it is confirmed that the conveyance amount is sufficiently acquired, the imaging operation is restarted.

In the second embodiment, the height h2 of the powder surface is higher than the lower limit value. Thus, the pumped-up amount of the developer on the developing roller 27 may not be insufficient immediately when the height of the powder surface increases more than the height h2. The conveyance amount of the developer is controlled to be increased by detecting that the height of the powder surface tends to decrease, before the height of the powder surface decreases at the lower limit value. Therefore, the image operation may not be discontinued for the conveyance amount control. However, when the fluctuation width becomes zero, the imaging operation is discontinued and the conveyance amount of the developer is increased.

As described above, it is detected whether the height of the powder surface of the developer is equal to or higher than a predetermined height, and the conveyance amount of the developer toward the developing part 6-2 is controlled based on this detection result. Therefore, it is possible to retain the height of the powder surface of the developer at the downstream in the flow direction of the developer by the conveyance screw 28, to be equal to or higher than the lower limit value. Also, it is possible to effectively prevent the occurrence of the image density irregularity due to the fluctuation of the conveyance amount of the developer.

In the second embodiment, a color printer is exemplified as the image forming apparatus. The image forming apparatus to which the second embodiment is applied is not limited to the color printer. Also, the second embodiment is applicable for a copier, a plotter, a facsimile machine, a multi-functional apparatus including these functions, and the like.

In the second embodiment, it is detected whether the height of the powder surface of the developer is equal to or greater than the predetermined height. An operation of the developer conveyance part is controlled so that the height of the powder surface becomes less than the predetermined height. Hence, the conveyance amount of the developer is controlled. It is possible to prevent an occurrence of lowering the powder surface of the developer at the downstream in the flow direction of the developer of the developer supply member. Also, it is possible to acquire a stable pump-up amount of the developer in the entire developer carrier and to successively perform the preferable image forming operations.

Accordingly, it is possible to provide the developing device 23-2 in which the height of the powder surface of the developer at the downstream of the conveyance screw 28 is retained, regardless of a scale of the pulsation of the conveyance amount. Also, it is possible to provide the image forming apparatus 1 including the developing device 23-2.

The present invention is not limited to the specifically disclosed embodiments, and variations and modifications may be made without departing from the scope of the present invention.

The present application is based on the Japanese Priority Applications No. 2010-247846 filed Nov. 4, 2010 and No. 2010-247850 filed Nov. 4, 2010, the entire contents of which are hereby incorporated by reference.

What is claimed is:

1. A developing device, comprising:

a developing part configured to include a developer carrier which is arranged in a vicinity of an image carrier, and which is rotatable for circulating a developer inside the developing part and for supplying the developer to the image carrier;

a developer supply member which is rotatable and carries and supplies the developer to the developer carrier; and a developer collection member which collects the developer which is not used to develop an image;

a developer stirring part configured to be arranged at a different position from a position of the developing part;

a developer conveyance part configured to carry the developer by an air conveyance in a developer conveyance path from the developer stirring part to the developing part, in which the developer being circulated in the developing part returns to the developer stirring part through a developer ejection flow path; and a developer detection part configured to include an opening which communicates between the developer supply member and the developer collection member, to be arranged at a downstream side in a flow direction of the developer from the opening below and near the developer supply member, and to detect whether the developer exists in a vicinity of the developer supply member.

2. The developing device as claimed in claim 1, wherein the developer detection part is arranged to incline toward the opening.

3. The developing device as claimed in claim 1, further including a second opening which communicates between the developer supply member and the developer collection member at the downstream of the flow direction of the developer in the developer supply member from the developer detection part.

4. The developing device as claimed in claim 3, wherein the developer detection part detects that the developer does not exist with an additional amount with respect to a lower limit of a conveyance amount of the developer, the lower limit being where an excess developer is depleted in the developing part, and the opening is formed to have an area for assuring the additional amount.

5. The developing device as claimed in claim 3, further comprising a second developer detection part configured to be arranged above and near the developer supply member and at a position corresponding to the second opening, and to detect whether the developer exists in a vicinity of the developer supply member.

6. The developing device as claimed in claim 5, wherein the conveyance amount of the developer carried by the developer conveyance part to the developing part is controlled based on detection results of the developer detection part and the second developer detection part.

7. The developing device as claimed in claim 1, wherein the conveyance amount of the developer, which is carried by the developer conveyance part to the developing part, is controlled based on a detection result of the developer detection part.

8. The developing device as claimed in claim 7, wherein when the developer detection part detects that the developer does not exist in the vicinity of the developer supply member, the conveyance amount of the developer carried by the developer conveyance part to the developing part is increased.

9. The developing device as claimed in claim 7, wherein the developer conveyance part includes an air pump and increases the conveyance amount of the developer by increasing an air supply amount of the air pump.

10. The developing device as claimed in claim 7, wherein the developer conveyance part includes a rotary re-feeder and increases the conveyance amount of the developer by increasing a number of rotations of the rotary re-feeder.

11. An image forming apparatus, comprising the developing device as claimed in claim 1.

12. A developing device, comprising:

a developing part configured to include a developer carrier which is arranged in a vicinity of an image carrier, and which is rotatable for circulating a developer inside the developing part and for supplying the developer to the image carrier; and a developer supply member which is rotatable and carries and supplies the developer to the developer carrier;

a developer stirring part configured to be arranged at a different position from a position of the developing part;

a developer conveyance part configured to carry the developer by an air conveyance in a developer conveyance path from the developer stirring part to the developing part, in which the developer being circulated in the developing part returns to the developer stirring part through a developer ejection flow path; and a powder surface detection part configured to detect a powder surface of the developer contained in the developing part in a vicinity of and below the developer supply member, wherein a conveyance amount of the developer carried by the developer conveyance to the developing part is controlled so that a fluctuation width of an output value of the powder surface detection part exceeds a set value, and wherein a distance between the powder surface detection part and the developer supply member is set to be a pumped-up amount in which the developer is not depleted on the developer carrier.

13. The developing device as claimed in claim 12, wherein the developer supply member is a screw, and an external diameter of the developer supply member positioned above the powder surface detection part is formed to be smaller than other regions.

14. The developing device as claimed in claim 12, wherein the developer supply member is a screw and a shaft diameter positioned above the powder surface detection part is formed to be smaller than other regions.

15. The developing device as claimed in claim 12, wherein the fluctuation width of the output value of the powder surface detection part is determined based on a maximum value and a minimum value when the developer supply member rotates once.

16. The developing device as claimed in claim 12, wherein the developer conveyance part includes an air pump, and the conveyance amount of the developer is increased by increasing an air supply amount of the air pump.

17. An image forming apparatus, comprising the developing device as claimed in claim 12.

18. A developing device, comprising:

a developing part configured to include a developer carrier which is arranged in a vicinity of an image carrier, and which is rotatable for circulating a developer inside the developing part and for supplying the developer to the image carrier; and a developer supply member which is rotatable and carries and supplies the developer to the developer carrier;

a developer stirring part configured to be arranged at a different position from a position of the developing part;

a developer conveyance part configured to carry the developer by an air conveyance in a developer conveyance path from the developer stirring part to the developing part, in which the developer being circulated in the developing part returns to the developer stirring part through a developer ejection flow path; and a powder surface detection part configured to detect a powder surface of the developer contained in the developing part in a vicinity of and below the developer supply member, wherein a conveyance amount of the developer carried by the developer conveyance to the developing part is controlled so that a fluctuation width of an output value of the powder surface detection part exceeds a set value, and wherein when it is detected that the fluctuation width of the output value of the powder surface detection part tends to decrease, the conveyance amount carried by the developer conveyance part to the developing part is increased.

19. The developing device as claimed in claim 18, wherein the developer conveyance part includes a rotary re-feeder, and the conveyance amount of the developer is increased by increasing a rotation of the rotary re-feeder.

* * * * *